US007140139B2

(12) United States Patent
Markbreit et al.

(10) Patent No.: US 7,140,139 B2
(45) Date of Patent: Nov. 28, 2006

(54) APPARATUS AND METHOD FOR LOCKING A FIREARM TO PREVENT UNAUTHORIZED USE THEREOF

(75) Inventors: Dani Markbreit, Azor (IL); Nimrod Kaufmann, Hod Hasharon (IL)

(73) Assignee: Mul-T-Lock Technologies, Ltd., Yavane (IL)

( * ) Notice: Subject to any disclaimer, the term of this patent is extended or adjusted under 35 U.S.C. 154(b) by 47 days.

(21) Appl. No.: 10/497,878

(22) PCT Filed: Dec. 3, 2002

(86) PCT No.: PCT/IL02/00971

§ 371 (c)(1),
(2), (4) Date: Dec. 17, 2004

(87) PCT Pub. No.: WO03/048672

PCT Pub. Date: Jun. 12, 2003

(65) Prior Publication Data

US 2005/0115131 A1 Jun. 2, 2005

(30) Foreign Application Priority Data

Dec. 7, 2001 (IL) ..... 146983

(51) Int. Cl.
*F41A 17/44* (2006.01)

(52) U.S. Cl. ..... 42/70.11; 42/70.01

(58) Field of Classification Search ..... 42/70.11, 42/70.01; 70/34, 58
See application file for complete search history.

(56) References Cited

U.S. PATENT DOCUMENTS

| | | | | |
|---|---|---|---|---|
| 3,018,576 | A * | 1/1962 | Riechers | 42/70.11 |
| 3,089,272 | A * | 5/1963 | McKinlay | 42/70.11 |
| 3,605,311 | A * | 9/1971 | Hermann | 42/70.11 |
| 5,231,236 | A * | 7/1993 | Del Real et al. | 42/70.11 |
| 5,669,252 | A * | 9/1997 | Bentley | 70/14 |
| 5,699,687 | A * | 12/1997 | Pittman | 70/376 |
| 6,662,484 | B1 * | 12/2003 | Andree et al. | 42/70.11 |
| 2003/0014897 | A1 * | 1/2003 | Burigana | 42/70.11 |

* cited by examiner

*Primary Examiner*—Michael J. Carone
*Assistant Examiner*—Bret Hayes
(74) *Attorney, Agent, or Firm*—Nixon & Vanderhye P.C.

(57) ABSTRACT

A firearm lock and a firearm locking method including a key-operated lock, which is lockingly engageable with an interior portion of a firing chamber of a firearm. The lock comprises: a cylinder lock body including a plug rotatable therewithin; an inner multiply grooved generally circular cylindrical portion fixed to or integrally formed with a first end of the lock body; and an outer circular cylindrical portion correspondingly multiply grooved generally circular cylindrical portion, fixed to or integrally formed with the plug for rotation therewith between a locked orientation, wherein grooves on the inner cylindrical portion are arranged out of phase with corresponding grooves on the outer cylindrical portion, and an unlocked orientation, wherein the grooves on the inner and outer cylindrical portions are mutually aligned.

12 Claims, 28 Drawing Sheets

FIG. 1A
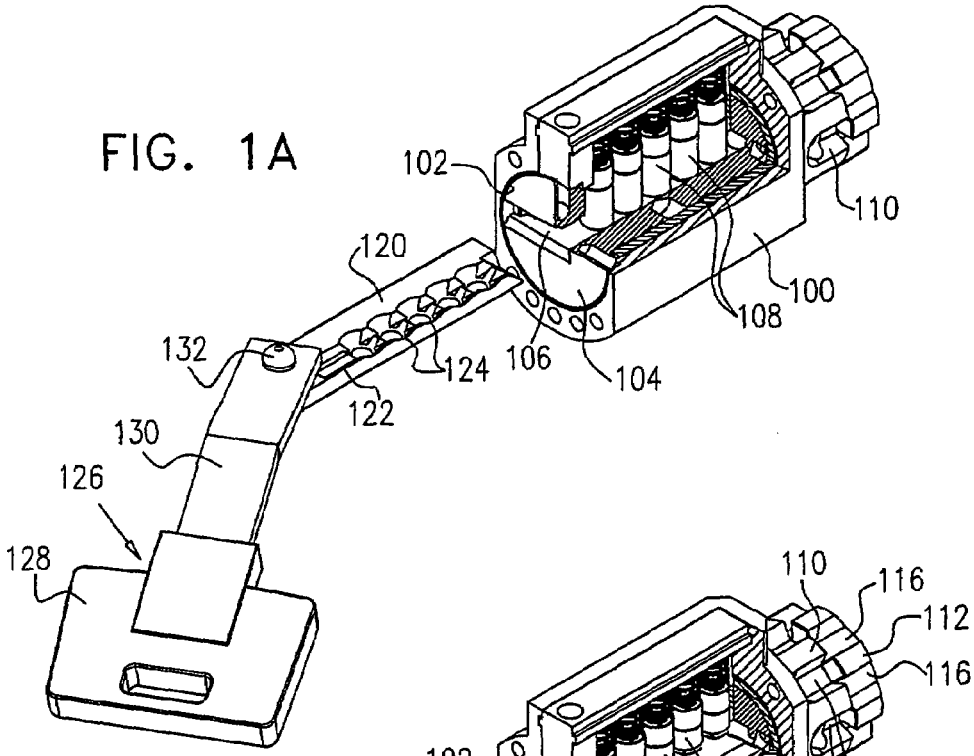
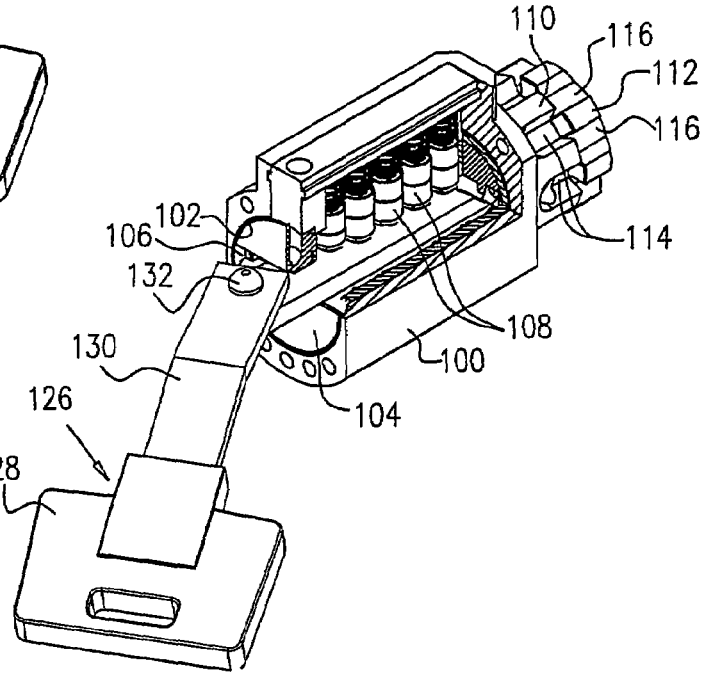
FIG. 1B
FIG. 1C
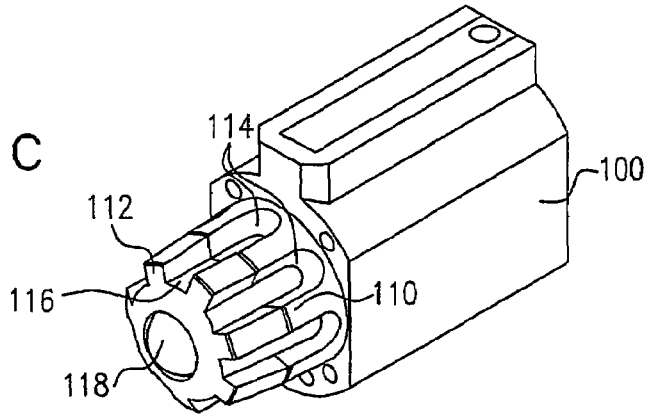

APPARATUS AND METHOD FOR LOCKING A FIREARM TO PREVENT UNAUTHORIZED USE THEREOF

REFERENCES TO RELATED APPLICATIONS

This application is the US national phase of international application PCT/IL02/00971 filed 3 Dec. 2002 which designated the U.S. and claims benefit of Israel Patent Application No. 146,983, filed on Dec. 7, 2001 and entitled: "Apparatus And Method For Locking A Firearm To Prevent Unauthorized Use Thereof", the entire contents of both of which applications are incorporated by reference.

FIELD OF THE INVENTION

The present invention relates to locks generally and more particularly to locking of firearms.

BACKGROUND OF THE INVENTION

Various types of firearm locks are known in the patent literature. The following U.S. Patents are believed to represent the current state of the art: U.S. Pat. Nos. 5,992,076; 5,488,794; 5,465,519; 5,450,685; 5,419,069; 5,410,832; 5,361,526; 5,357,704; 5,331,759; 5,241,769; 5,239,767; 5,231,236; 5,115,589; 5,062,233; 5,044,105; 4,965,952; 4,835,894; 4,761,906; 4,709,496; 4,672,762; 4,654,992; 4,619,062; 4,532,729; 4,576,021; 4,528,765; 4,461,108; 4,398,366; 4,276,707; 4,266,356; 3,774,333; 3,605,311; 3,504,818; 3,378,943; 3,137,957; 3,089,272; 2,997,802; 2,763,081; 2,327,334; 1,728,902; 1,572,122.

Published PCT Patent Applications: WO 92/15835; 92/13249; 92/10714; 92/06345; 88/09475; 88/06264; 86/00396; and 82/02941.

UK Published Patent Applications: 2,238,604; 2,234,047; 2,215,822; and 2,220,253.

German Offenlegungsschriften DE 4119617; DE 3323501; DE 2920679; and DE 2908066.

German Patent 602163; European Published Patent Application 0163912, and applicant/assignee's PCT Patent Application PCT/US96/03446.

Applicant/assignee's PCT Patent Applications PCT/US96/03446 and PCT/IL98/00228, the disclosures of which are incorporated herein by reference.

SUMMARY OF THE INVENTION

The present invention seeks to provide an improved firearm lock as well as improved firearm locking methodology for preventing unauthorized use of firearms.

There is thus provided in accordance with a preferred embodiment of the present invention a firearm lock including:

a lock which is lockingly engageable with an interior portion of a firing chamber of a firearm.

There is also provided in accordance with a preferred embodiment of the present invention, a firearm locking method including:

lockingly engaging a lock with an interior portion of a firing chamber of a firearm.

Preferably, the lock is lockingly engageable with the interior portion of the firing chamber at a location between the firing chamber and the barrel, whereby the presence of the lock effectively blocks a bullet travel path and prevents firing of the firearm.

In accordance with a preferred embodiment of the present invention, the firearm lock is insertable into locking engagement with the firearm via a magazine holder of the firearm.

Preferably, the firearm lock is key-operated.

In accordance with a preferred embodiment of the present invention, locking and unlocking of the firearm lock is carried out via an aperture communicating with the firing chamber of the firearm.

Preferably, the lock includes:

a cylinder lock body including a plug rotatable therewithin;

an inner multiply grooved generally circular cylindrical portion fixed to or integrally formed with a first end of the lock body; and an outer circular cylindrical portion correspondingly multiply grooved generally circular cylindrical portion, fixed to or integrally formed with the plug for rotation therewith between a locked orientation, wherein grooves on the inner cylindrical portion are arranged out of phase with corresponding grooves on the outer cylindrical portion, and an unlocked orientation, wherein the grooves on the inner and outer cylindrical portions are mutually aligned.

In accordance with a preferred embodiment of the present invention, the lock lockingly engages a flange in the firearm.

Preferably, the lock lockingly engages a flange which also serves to mount a firearm barrel in alignment with the firing chamber.

In accordance with a preferred embodiment of the present invention, the outer cylindrical portion is formed with a hardened or otherwise reinforced central portion in order to provide security against drilling therethrough.

Preferably, the presence of the lock in the firing chamber causes a firing mechanism of the firearm to extend partially into a firearm barrel, thus preventing rotation of the barrel with respect to the firing chamber.

BRIEF DESCRIPTION OF THE DRAWINGS

The present invention will be understood and appreciated more fully from the following detailed description, taken in conjunction with the drawings in which:

FIG. 1A is a simplified, partially cut away pictorial illustration of a firearm chamber lock and key assembly constructed and operative in accordance with a preferred embodiment of the present invention, in a locked orientation, wherein the key is outside the lock;

FIG. 1B is a simplified, partially cut away pictorial illustration of the firearm chamber lock and key assembly of FIG. 1A in a locked orientation, wherein the key is fully inserted in the lock;

FIG. 1C is a simplified, pictorial illustration of the firearm chamber lock of FIGS. 1A and 1B in an opposite facing orientation;

DETAILED DESCRIPTION OF PREFERRED EMBODIMENTS

Figure 2A:
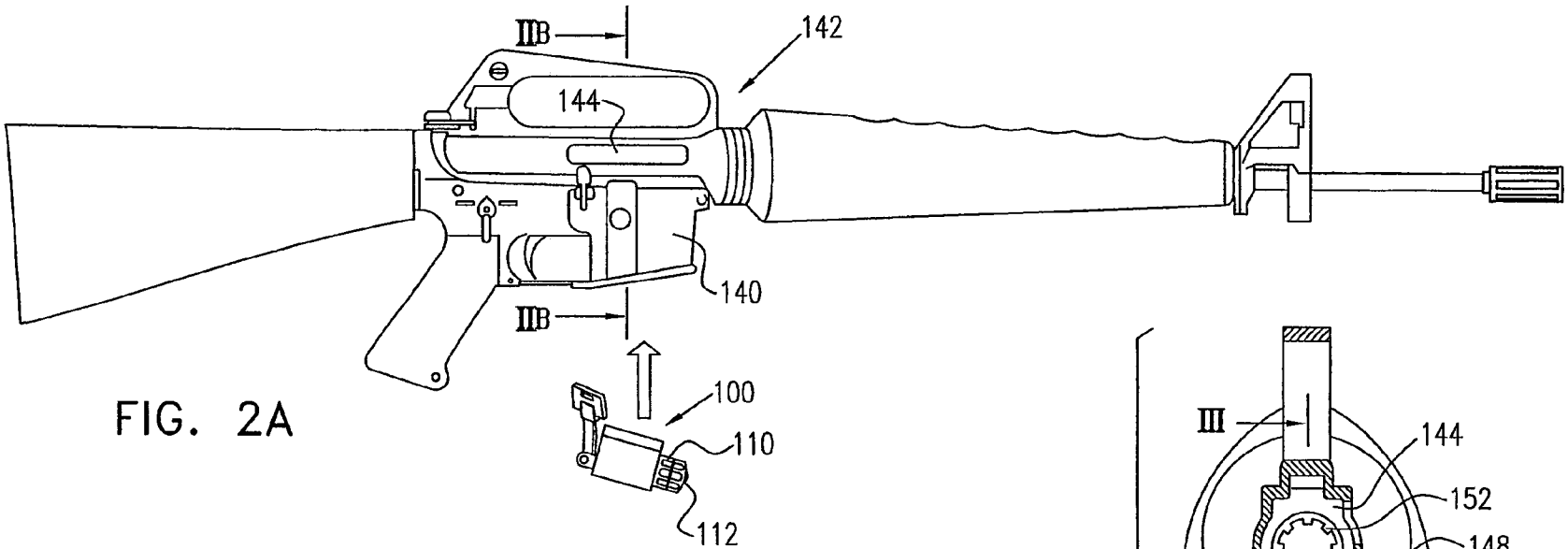
FIGS. 2A and 2B are respective side view and sectional illustrations showing an initial stage in insertion of the firearm chamber lock and key assembly of FIGS. 1A–1C into operative locking engagement with a firearm.

Reference is now made to FIGS. 1A, 1B and 1C, which illustrate a firearm chamber lock and key assembly constructed and operative in accordance with a preferred embodiment of the present invention, in a locked orientation.

As seen in FIGS. 1A–1C, the firearm chamber lock and key assembly preferably comprises a cylinder lock body 100 which has a generally non-circularly cylindrical outer configuration, preferably adapted to be insertable through the magazine holder of a firearm, preferably an M-16 rifle, and to slidably engage the forward portion of the chamber of the firearm. Lock body 100 preferably defines a bore 102 in which is disposed a lock cylinder plug 104 defining a keyway 106 and a plurality of lock pins 108 in operative engagement therewith.

An inner multiply grooved generally circular cylindrical portion 110 is fixed to or integrally formed with a first end of lock body 100, while an outer circular cylindrical portion correspondingly multiply grooved generally circular cylindrical portion 112 is fixed to or integrally formed with plug 104 and rotates therewith between a locked orientation, such as that shown in FIGS. 1A–1C, wherein grooves 114 on cylindrical portion 110 are arranged out of phase with corresponding grooves 116 on cylindrical portion 112, and an unlocked orientation, wherein grooves 114 and 116 are mutually aligned.

Preferably outer cylindrical portion 112 is formed with a hardened or otherwise reinforced central portion 118 in order to provide security against drilling therethrough.

Any suitable key may be employed in the firearm lock of FIGS. 1A–1C. One embodiment of a preferred key assembly is an articulated key assembly including a shank portion 120 having formed thereon at least one key guide 122 and a plurality of key cuts 124 which establish a pin position combination which preferably corresponds to the configuration of the locking pins 108 in the lock 100.

In the illustrated embodiment, a handle portion 126 is pivotably attached to shank portion 120. Handle portion 126 preferably comprises a key head 128 which is attached to one end of a handle shaft 130, whose other end is pivotably attached to shank portion 120, typically via a rivet 132. Handle shaft 130 may be advantageously bend to facilitate manipulation of the key assembly, as will be understood from the description which follows. It is to be appreciated that any other suitable key structure and functionality may alternatively be employed.

Figure 2B:
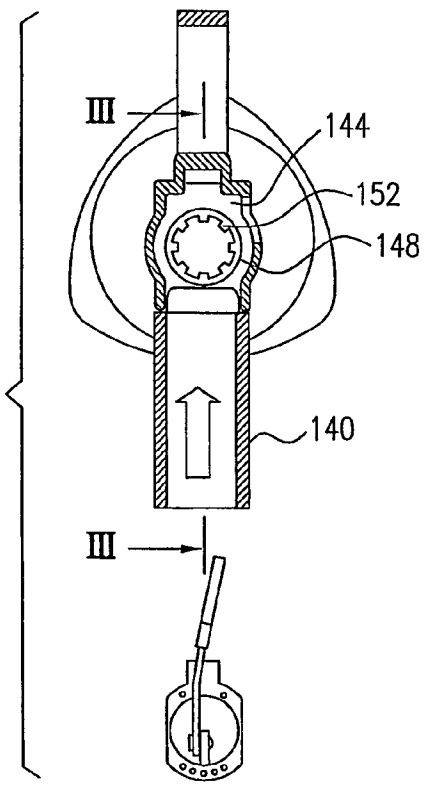
Figure 3:
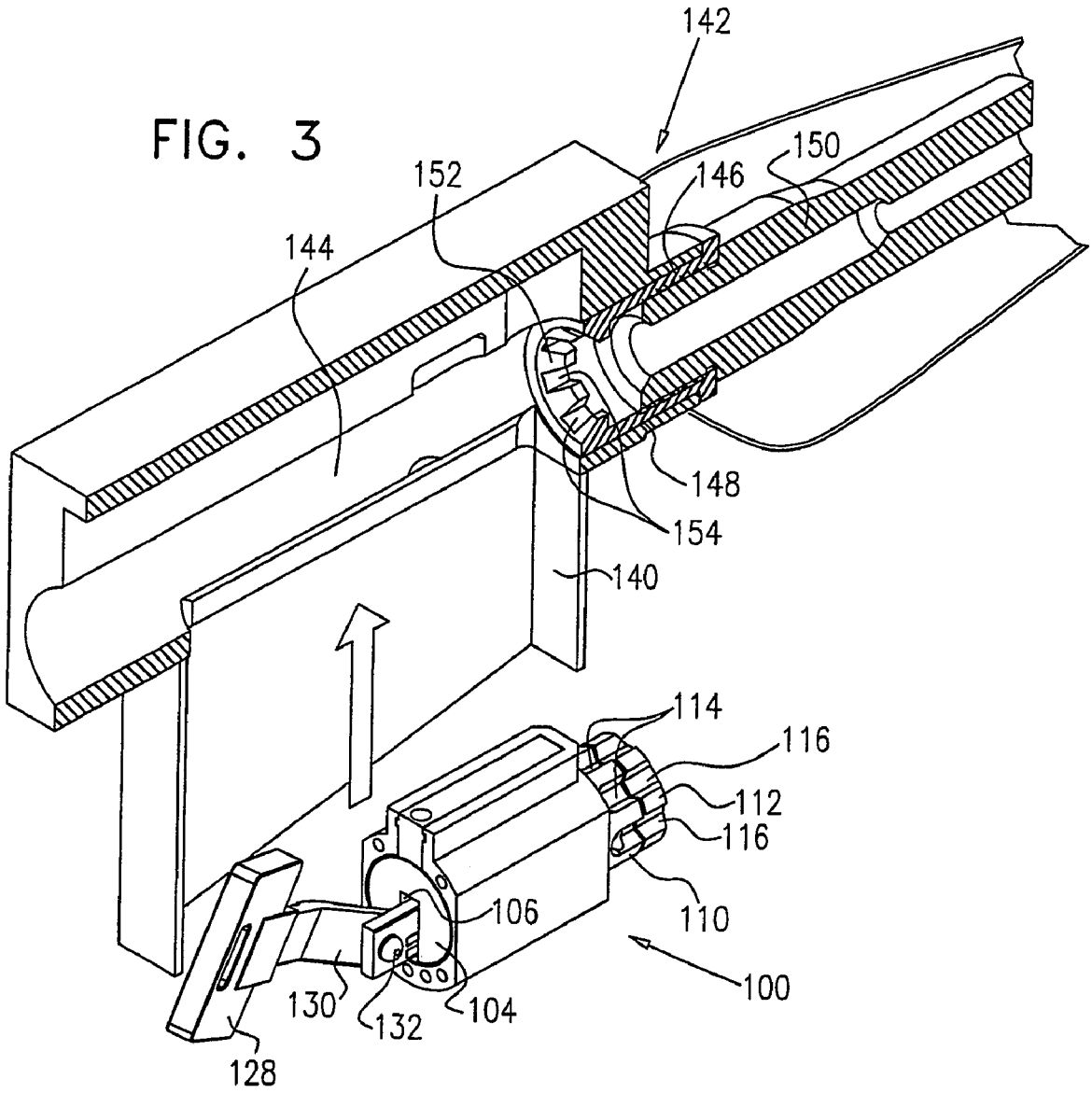
FIG. 3 is a partially pictorial, partially sectional illustration taken along lines III—III in FIG. 2B and showing details of the structure of the firearm, which is to be lockingly engaged by the firearm chamber lock.

Reference is now made to FIGS. 2A and 2B, which are respective side view and sectional illustrations showing an initial stage in insertion of the firearm chamber lock and key assembly of FIGS. 1A–1C into operative locking engagement with a firearm and to FIG. 3, taken along lines III—III in FIG. 2B, which shows details of the structure of the firearm which is to be lockingly engaged by the firearm chamber lock.

As seen in FIGS. 2A, 2B and 3, the firearm chamber lock 100 FIGS. 1A–1C is preferably inserted via the magazine holder 140 of a rifle 142, preferably an M-16 rifle, into engagement with a firing chamber 144 thereof. As seen particularly in FIG. 3, at the forward end of firing chamber 144, there is preferably provided a barrel connecting flange element 146, which is seated in a bore 148, forward of firing chamber 144. A barrel 150 is preferably threadably mounted onto an interior surface of flange element 146.

Flange element 146 is preferably formed with an interior facing toothed ring portion 152 at an end thereof facing the firing chamber 144 and opposite from the end to which the barrel 150 is mounted. It is a particular feature of the present invention that lock 100 is configured and operative to lockingly engage the toothed ring portion 152, thereby blocking the firing chamber and preventing removal of the flange element 146 from its location in bore 148. In accordance with a preferred embodiment of the present invention, toothed ring portion 152 defines a plurality of radially inwardly directing grooves 154 whose configuration and orientation is such as to allow axially slidable passage therepast of the solid portions between grooves 114 on cylindrical portion 110 and corresponding grooves 116 on cylindrical portion 112 of lock 100, when the grooves 114 and 116 are mutually aligned, i.e. when the lock 100 is in an unlocked orientation.

Figure 4A:
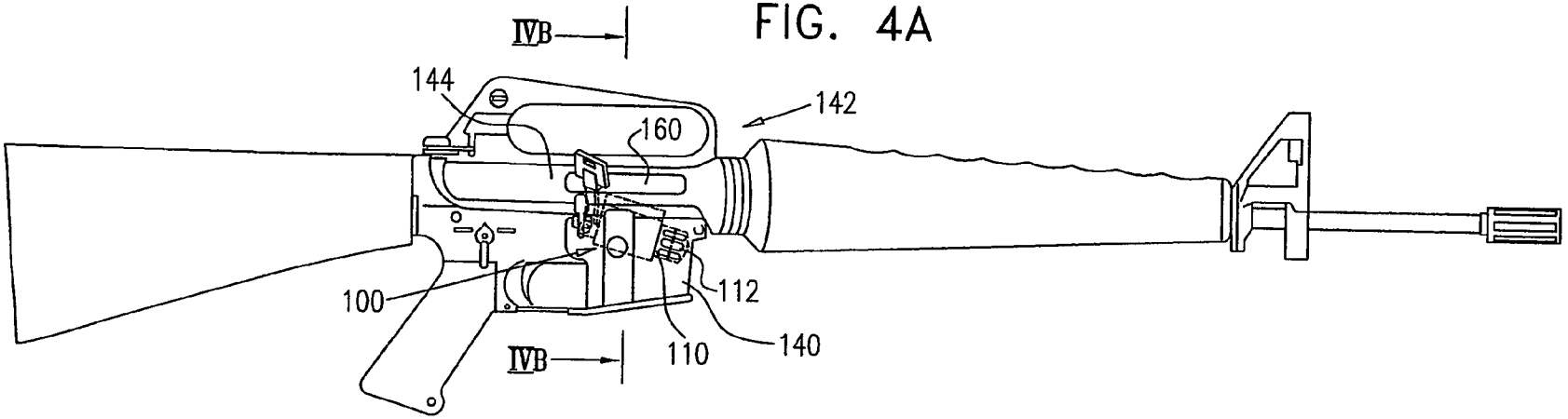
FIGS. 4A and 4B are respective side view and sectional illustrations showing a further stage in insertion of the firearm chamber lock and key assembly of FIGS. 1A–1C into operative locking engagement with a firearm.
Figure 4B:
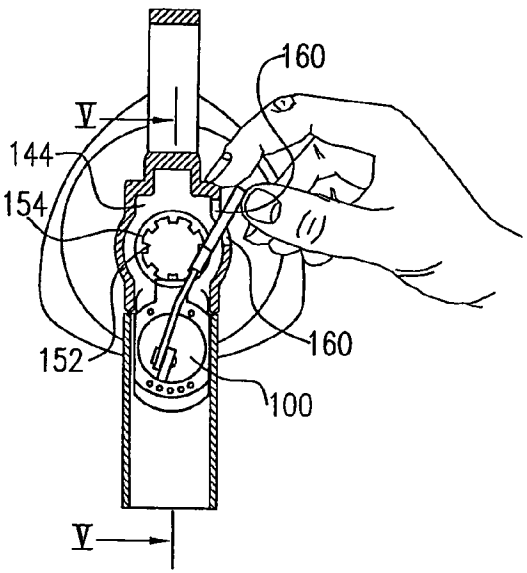
Figure 5:
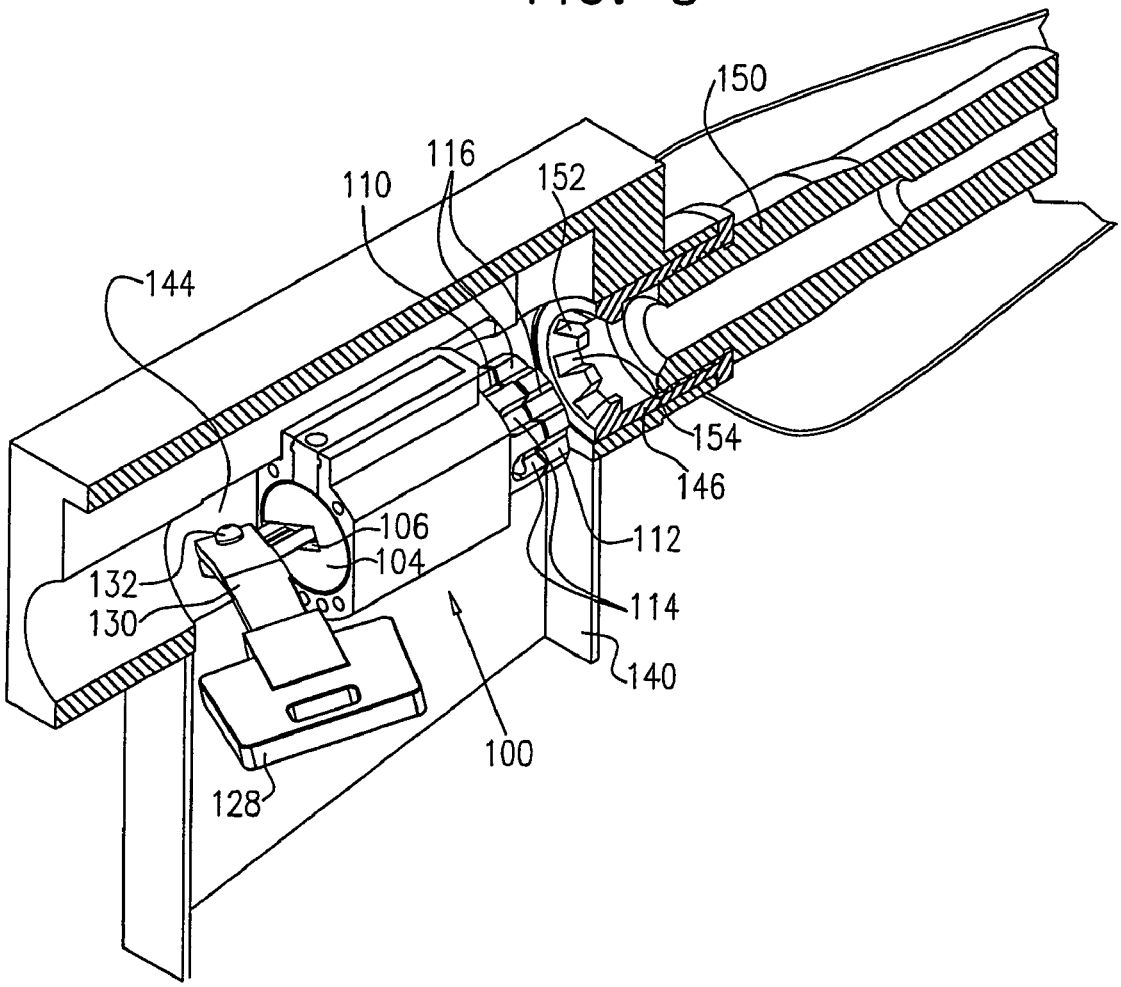
FIG. 5 is a partially pictorial, partially sectional illustration taken along lines V—V in FIG. 4B and showing details of the structure of the firearm which is to be lockingly engaged by the firearm chamber lock and the relative orientation thereof prior to locking engagement therebetween.

Reference is now made to FIGS. 4A and 4B, which are respective side view and sectional illustrations showing a further stage in insertion of the firearm chamber lock and key assembly of FIGS. 1A–1C into operative locking engagement with a firearm and to FIG. 5, taken along lines V—V in FIG. 4B, which shows details of the structure of the firearm which is to be lockingly engaged by the firearm chamber lock and the relative orientation thereof prior to locking engagement therebetween.

As seen in FIGS. 4A and 4B, the firearm chamber lock 100 FIGS. 1A–1C is located partly in the magazine holder 140 of rifle 142 and partly within firing chamber 144. The key head 128 typically extends through an aperture 160 formed of firing chamber 144, assisting in the proper positioning of the lock 100 in the firing chamber, as seen particularly in FIG. 4B. As seen particularly in FIG. 5, thereafter, the lock 100 is located fully within firing chamber 144 and ready to be slid forward into engagement with flange element 146, at the forward end of firing chamber 144. At this stage, the key is preferably oriented in lock 100 such that the lock 100 is in an unlocked orientation, wherein grooves 114 and 116 on respective cylindrical portions 110 and 112 are mutually aligned, as shown.

Figure 6A:
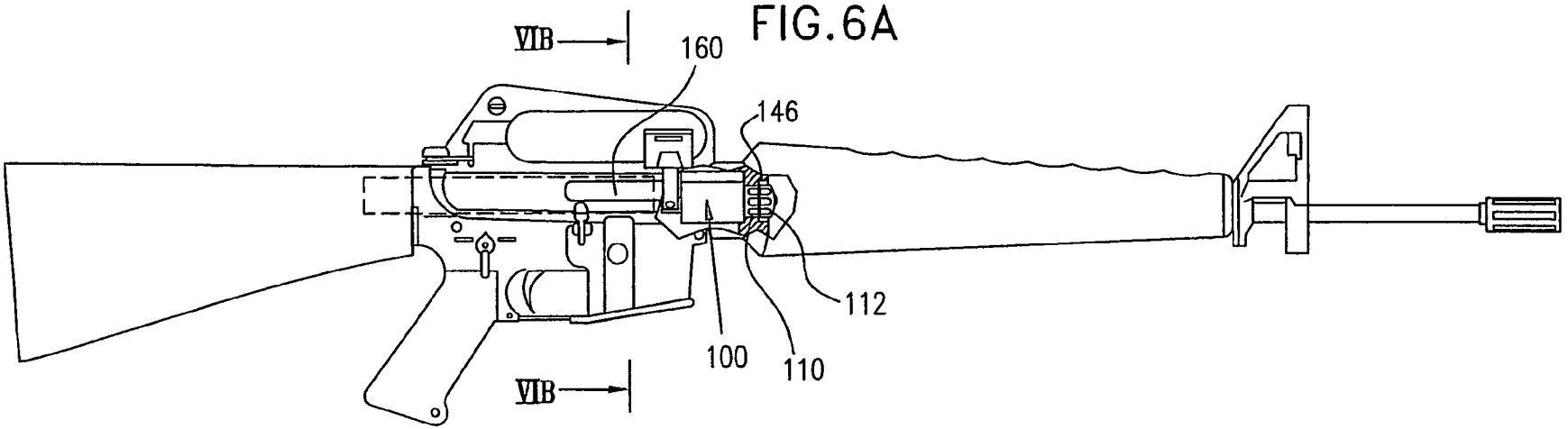
FIGS. 6A and 6B are respective side view and sectional illustrations showing a full insertion, pre-locking stage in insertion of the firearm chamber lock and key assembly of FIGS. 1A–1C into operative locking engagement with a firearm.
Figure 6B:
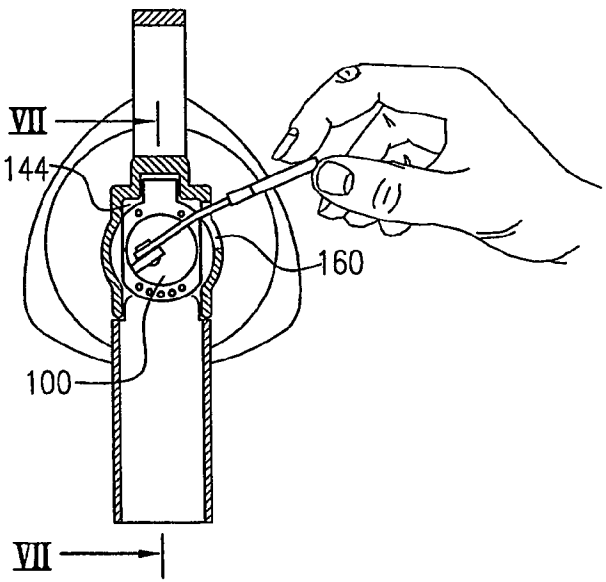
Figure 7:
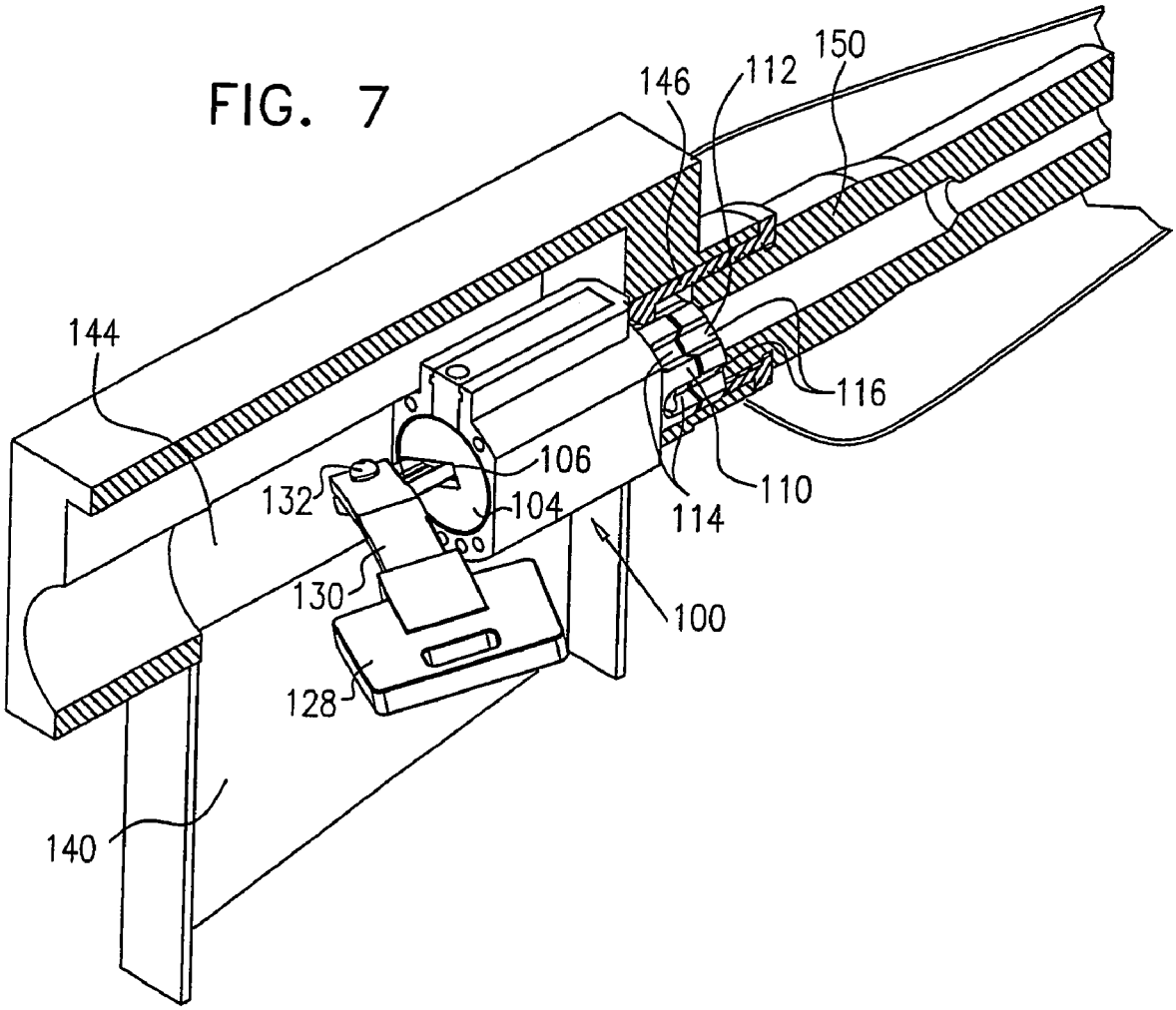
FIG. 7 is a partially pictorial, partially sectional illustration taken along lines VII—VII in FIG. 6B and showing details of the structure of the firearm, which is to be lockingly engaged by the firearm chamber lock.

Reference is now made to FIGS. 6A and 6B, which are respective side view and sectional illustrations showing a full insertion, pre-locking stage in insertion of the firearm chamber lock and key assembly of FIGS. 1A–1C into operative locking engagement with a firearm and to FIG. 7, taken along lines VII—VII in FIG. 6B, which shows unlocked engagement of the firearm chamber lock with the flange element 146.

As seen in FIGS. 6A, 6B and 7, the firearm chamber lock 100 FIGS. 1A–1C is located in unlocked engagement with flange element 146, at the forward end of firing chamber 144. At this stage grooves 114 and 116 on respective cylindrical portions 110 and 112 are mutually aligned, as shown. The grooves 114 on cylindrical portions 110 are preferably interdigitated with grooves 154 on toothed ring portion 152. The cylindrical portion 112, having slid past tooth ring portion 152, preferably lies entirely forward thereof inside flange element 146.

Figure 8A:
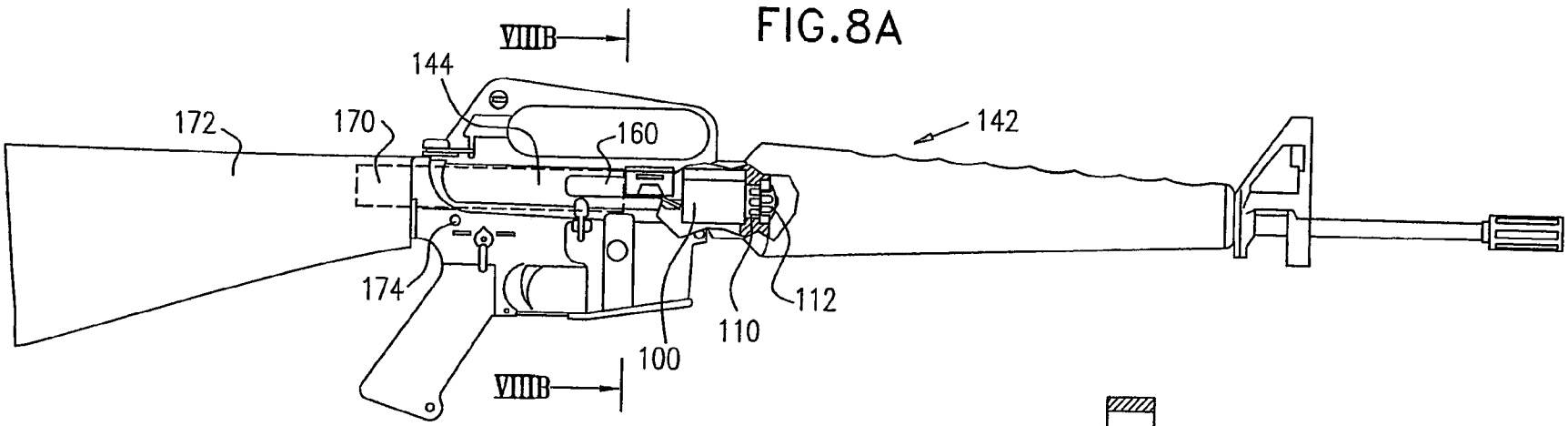
FIGS. 8A and 8B are respective side view and sectional illustrations showing locking engagement of the firearm chamber lock of FIGS. 1A–1C with a firearm.
Figure 8B:
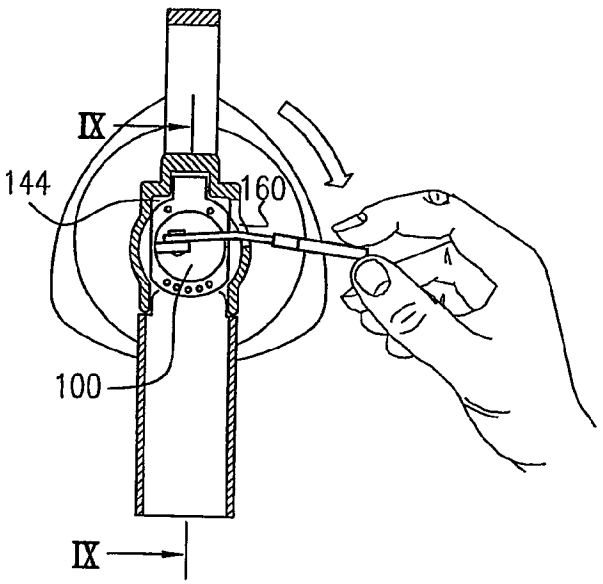
Figure 9:
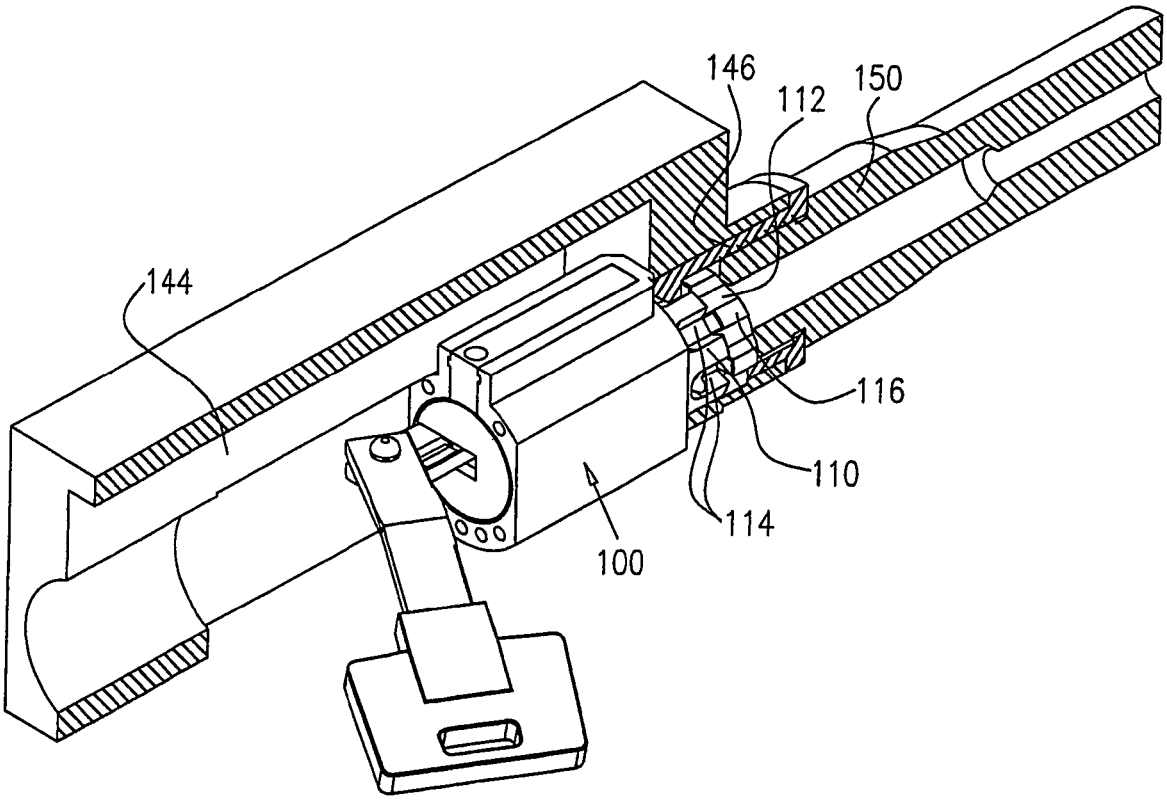
FIG. 9 is a partially pictorial, partially sectional illustration taken along lines IX—IX in FIG. 8B and showing details of the structure of the firearm lockingly engaged by the firearm chamber lock.

Reference is now made to FIGS. 8A and 8B, which are respective side view and sectional illustrations showing locking engagement of the firearm chamber lock of FIGS. 1A–1C with a firearm and to FIG. 9, taken along lines IX—IX in FIG. 8B, which shows details of the structure of the firearm lockingly engaged by the firearm chamber lock.

As seen in FIGS. 8A, 8B and 9, the firearm chamber lock 100 FIGS. 1A–1C is located in locked engagement with flange element 146, at the forward end of firing chamber 144. At this stage grooves 114 and 116 on respective cylindrical portions 110 and 112 are mutually out of phase, as shown. The grooves 114 on cylindrical portions 110 are preferably interdigitated with grooves 154 on toothed ring portion 152. The cylindrical portion 112, having slid past toothed ring portion 152, preferably lies entirely forward thereof inside flange element 146. The out of phase arrangement of grooves 116 with respect to grooves 114, thus prevents lock 100 from moving rearwardly out of engagement with toothed ring portion 152.

It is an additional feature of the present invention that when lock 100 lies in the firing chamber 144, as shown, inter alia, in FIGS. 8A, 8B and 9, the firing mechanism, indicated generally by reference numeral 170, is positioned rearwardly of lock 100 and thus extends into a corresponding cavity formed in the butt 172 of the rifle 142. In this orientation, the firing mechanism 170 prevents rotation of the butt 172 about a pivot pin 174 and thereby prevents removal of the butt 172, which could otherwise provide access to the lock 100 from the rear of the fixing chamber.

Figure 10A:
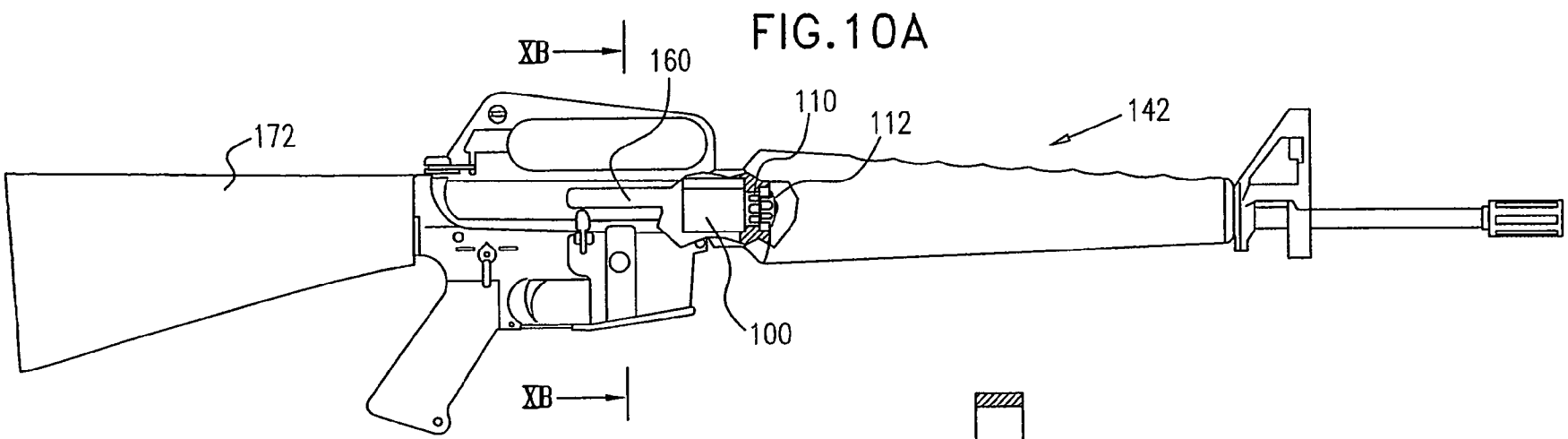
FIGS. 10A and 10B are respective side view and sectional illustrations showing a final stage in locking of the firearm chamber lock in operative locking engagement with a firearm, wherein the key has been removed from the lock and from the firearm.
Figure 10B:
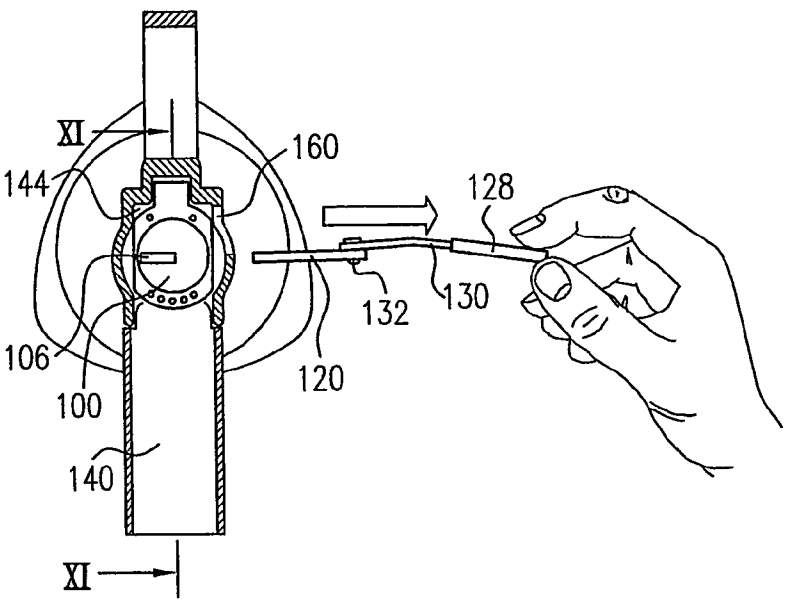
Figure 11:
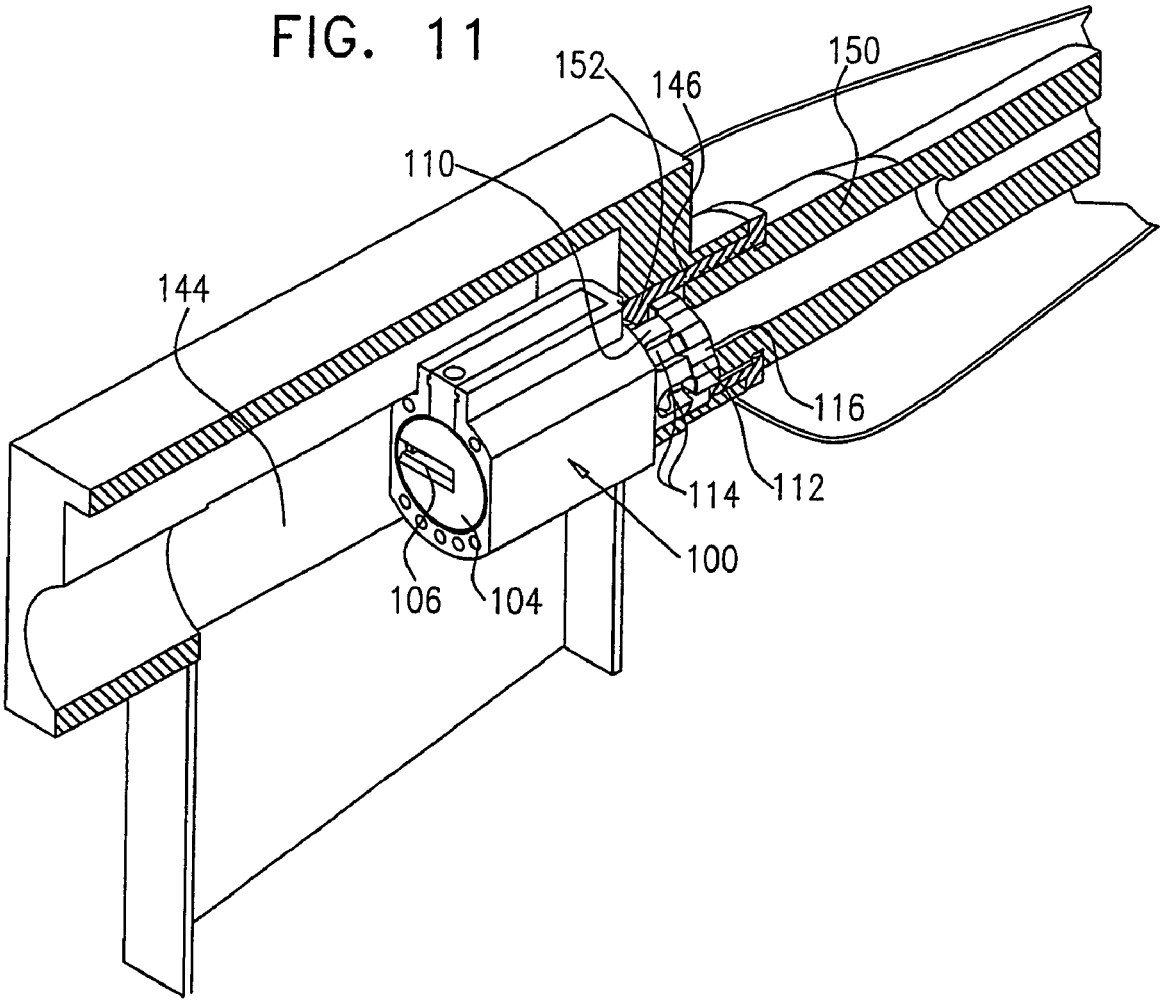
FIG. 11 is a partially pictorial, partially sectional illustration taken along lines XI—XI in FIG. 10B and showing details of the structure of the firearm lockingly engaged by the firearm chamber lock following removal of the key from the lock.

Reference is now made to FIGS. 10A and 10B, which are respective side view and sectional illustrations showing a final stage in locking of the firearm chamber lock in operative locking engagement with a firearm, wherein the key has been removed from the lock and from the firearm and to FIG. 11, taken along lines XI—XI in FIG. 10B, which shows details of the structure of the firearm lockingly engaged by the firearm chamber lock following removal of the key from the lock.

As seen in FIGS. 10A, 10B and 11, the firearm chamber lock 100 FIGS. 1A–1C is located in locked engagement with flange element 146, at the forward end of firing chamber 144. At this stage the key assembly is removed, preferably via aperture 160. At this stage, the firearm is locked and cannot be fired.

Figure 12A:
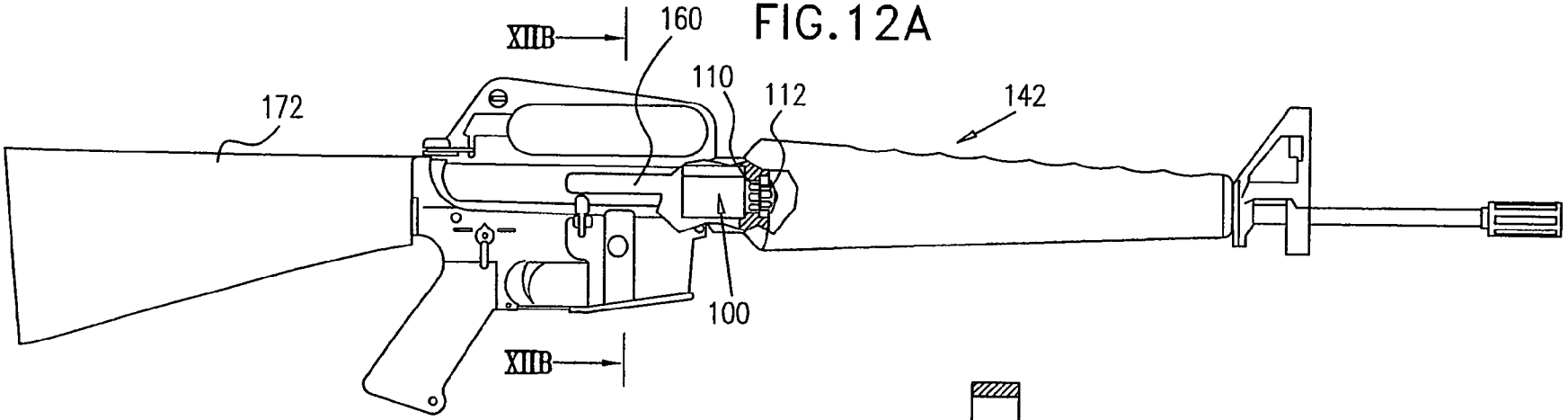
FIGS. 12A and 12B are respective side view and sectional illustrations showing an initial stage in removal of the firearm chamber lock and key assembly of FIGS. 1A–1C from operative locking engagement with a firearm.
Figure 12B:
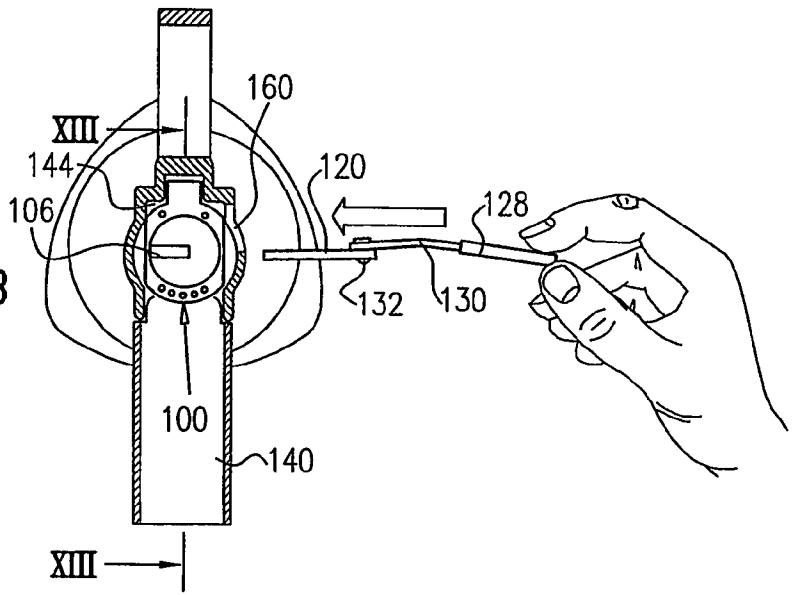
Figure 13:
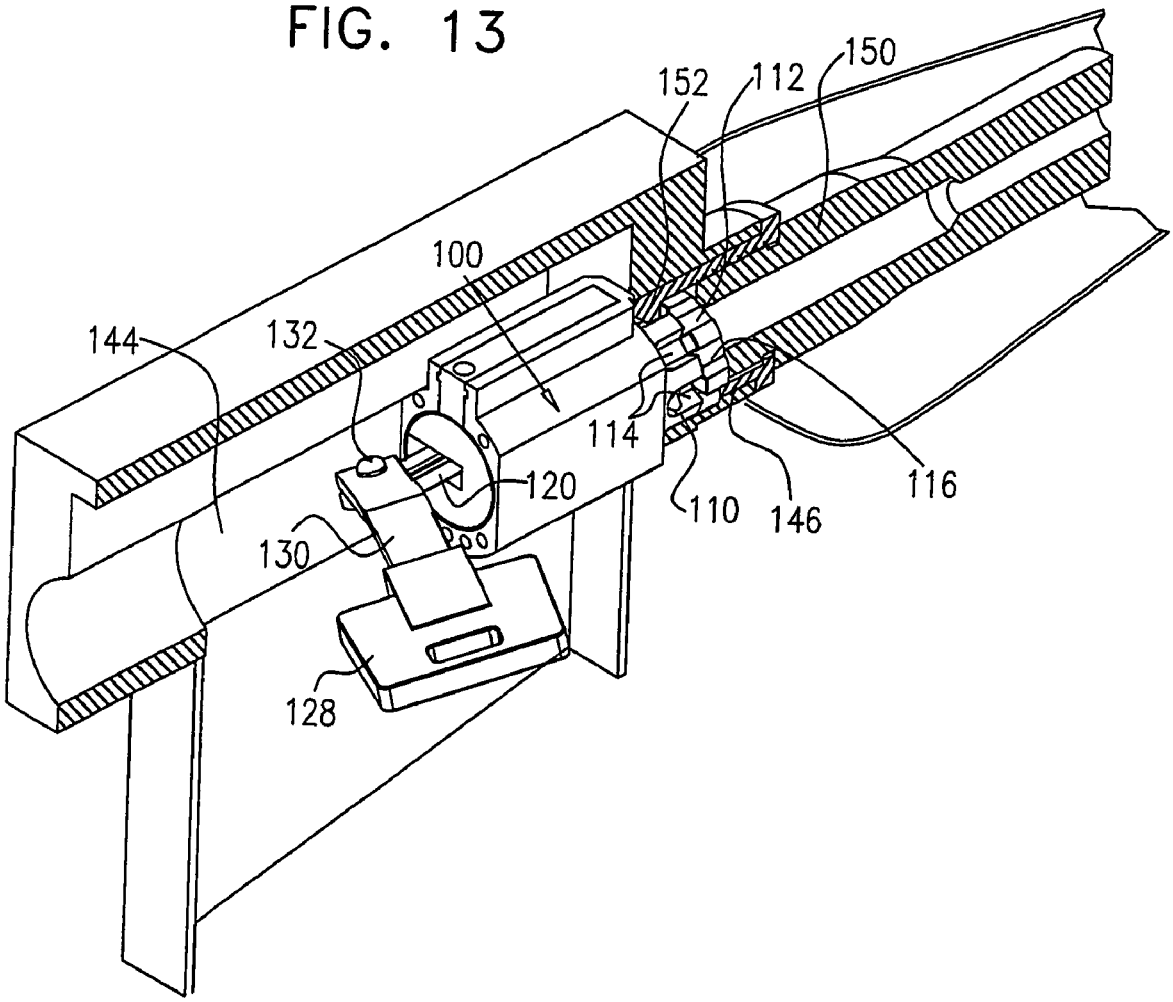
FIG. 13 is a partially pictorial, partially sectional illustration taken along lines XIII—XIII in FIG. 12B and showing details of the structure of the firearm lockingly engaged by the firearm chamber lock following insertion of a key into the lock.

Reference is now made to FIGS. 12A and 12B, which are respective side view and sectional illustrations showing an initial stage in removal of the firearm chamber lock and key assembly of FIGS. 1A–1C from operative locking engagement with a firearm and to FIG. 13, taken along lines XIII—XIII in FIG. 12B, which shows details of the structure of the firearm lockingly engaged by the firearm chamber lock following insertion of a key into the lock.

As seen in FIGS. 12A, 12B and 13, the firearm chamber lock 100 FIGS. 1A–1C is located in locked engagement with flange element 146, at the forward end of firing chamber 144. At this stage, in order to unlock the firearm, the key assembly is inserted, preferably via aperture 160.

Figure 14A:
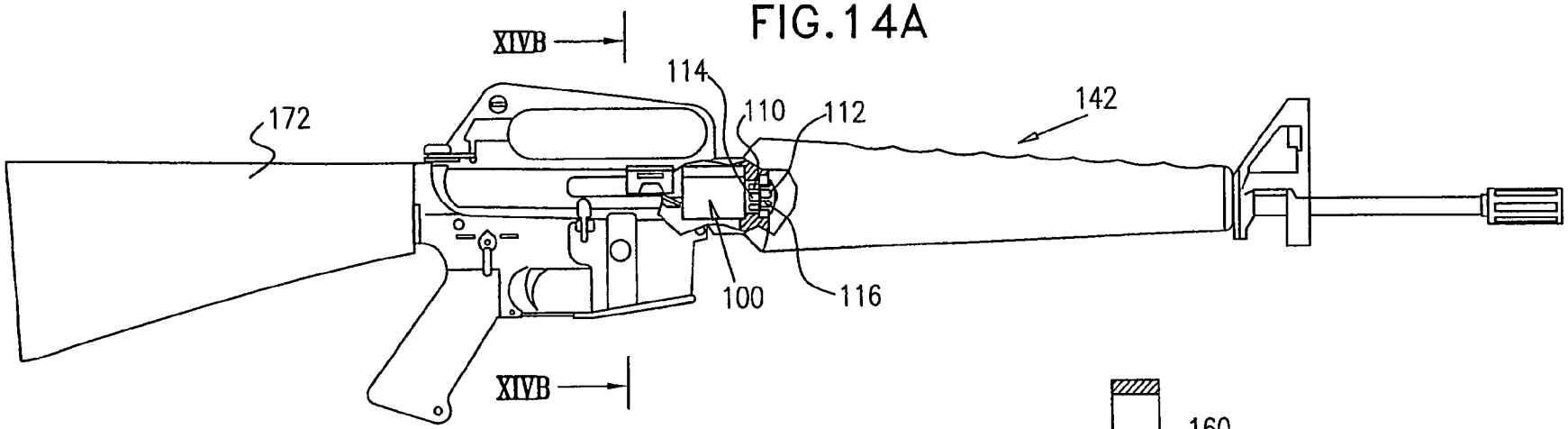
FIGS. 14A and 14B are respective side view and sectional illustrations showing unlocking of the firearm chamber lock and key assembly of FIGS. 1A–1C from operative locking engagement with a firearm.
Figure 14B:
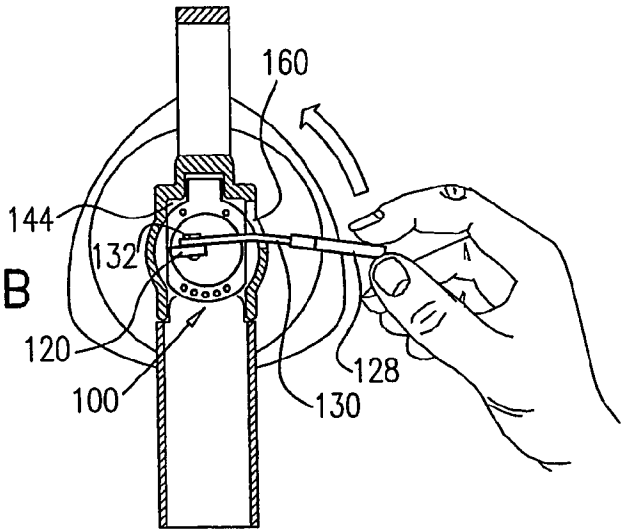
Figure 15A:
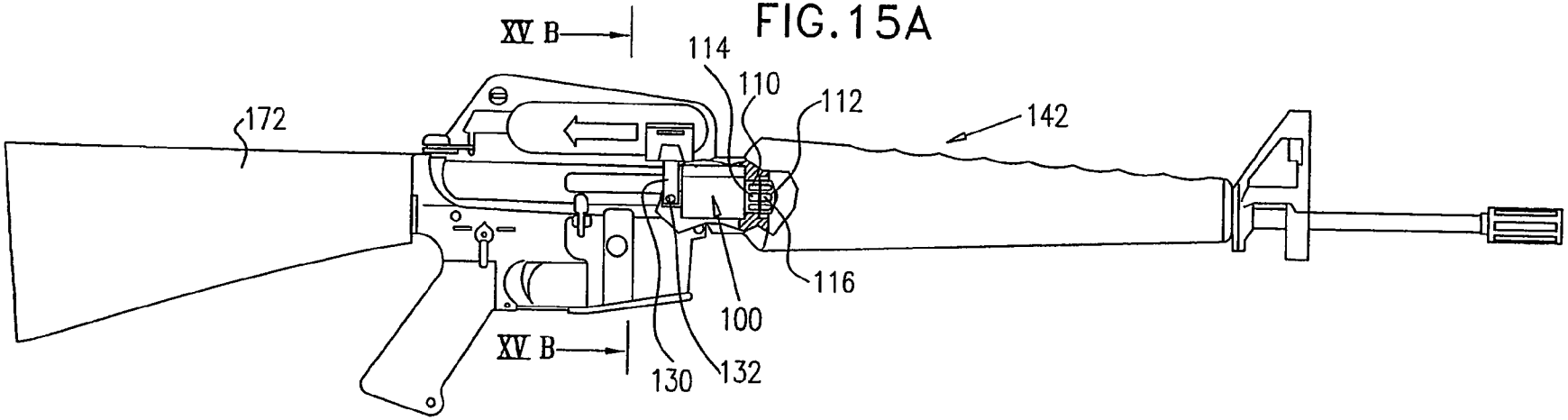
FIGS. 15A and 15B are respective side view and sectional illustrations showing the firearm chamber lock of FIGS. 1A–1C in unlocked engagement with a firearm.
Figure 15B:
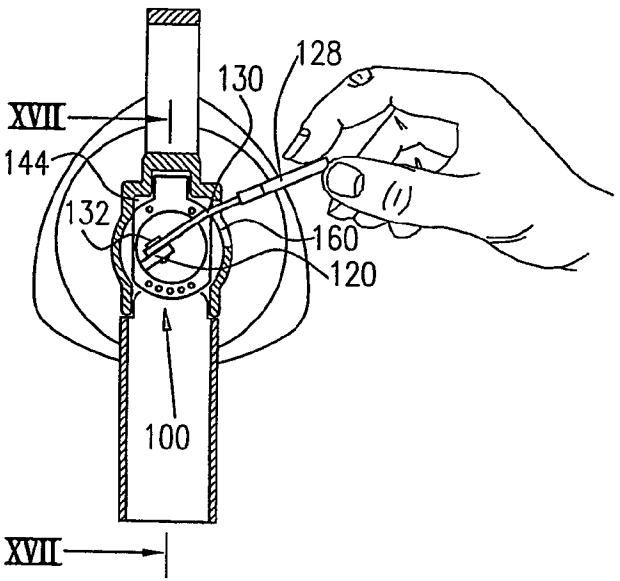
Figure 17:
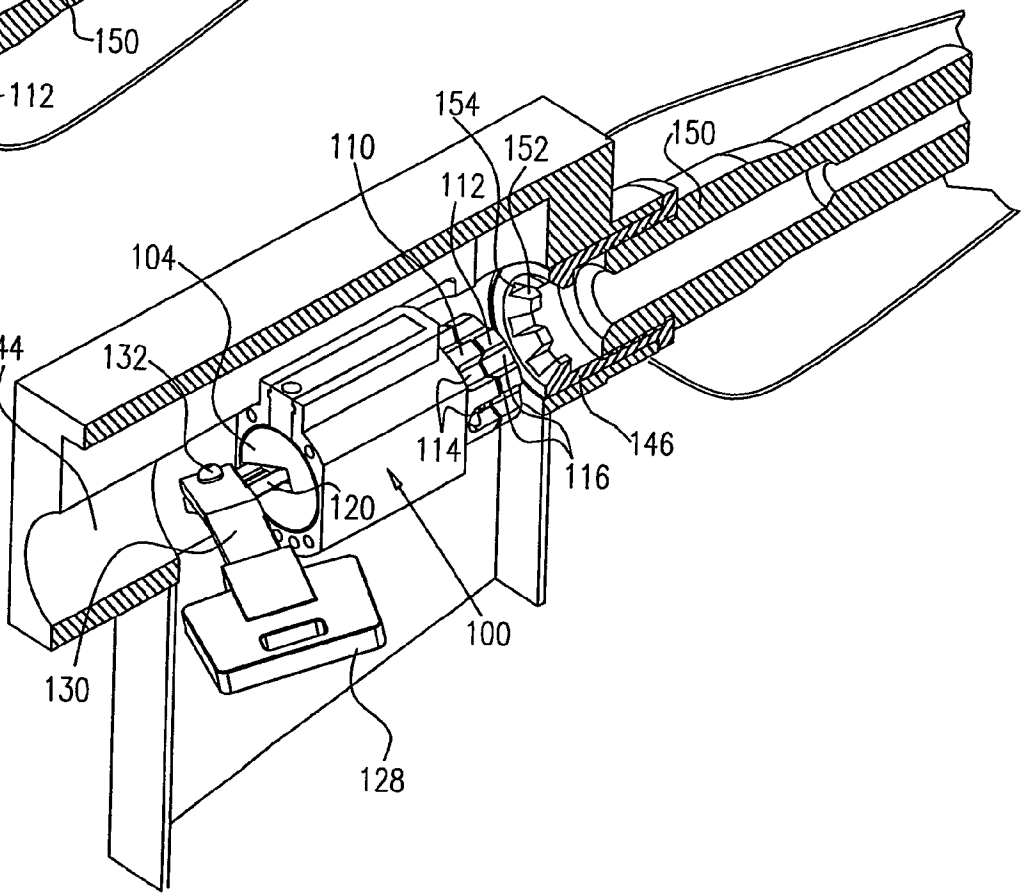
FIGS. 16 and 17 are partially pictorial, partially sectional illustrations taken along lines XVII—XVII in FIG. 15B and showing details of the structure of the firearm and the firearm chamber lock following unlocking of the lock and disengagement thereof from the firearm respectively.
Figure 16:
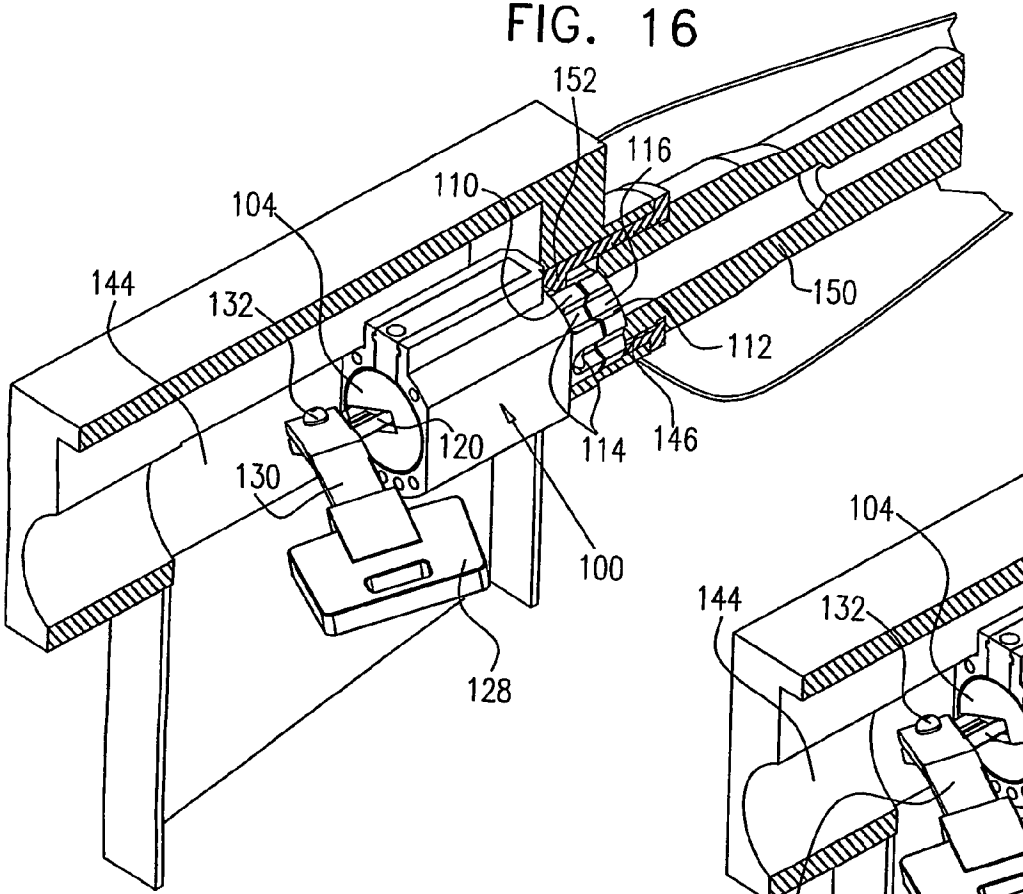

Reference is now made to FIGS. 14A and 14B and 15A and 15B which are respective side view and sectional illustrations showing unlocking of the firearm chamber lock and key assembly of FIGS. 1A–1C from operative locking engagement with a firearm, to FIGS. 16 and 17, taken along lines XVII—XVII in FIG. 15B, which show details of the structure of the firearm and the firearm chamber lock following unlocking of the lock.

As seen in FIGS. 14A and 14B, in order to unlock the firearm, the key assembly is rotated in engagement with the lock 100 so as to unlock the lock 100. The result of this rotation is a corresponding rotation of the plug 104 and of cylindrical portion 112, thereby aligning grooves 114 and 116 on respective cylindrical portions 110 and 112 as seen in FIGS. 15A, 15B and 16.

FIG. 16 shows the lock in an unlocked orientation in engagement with the flange element 146, while FIG. 17 shows the lock 100 following disengagement thereof from flange element 146.

Figure 18A:
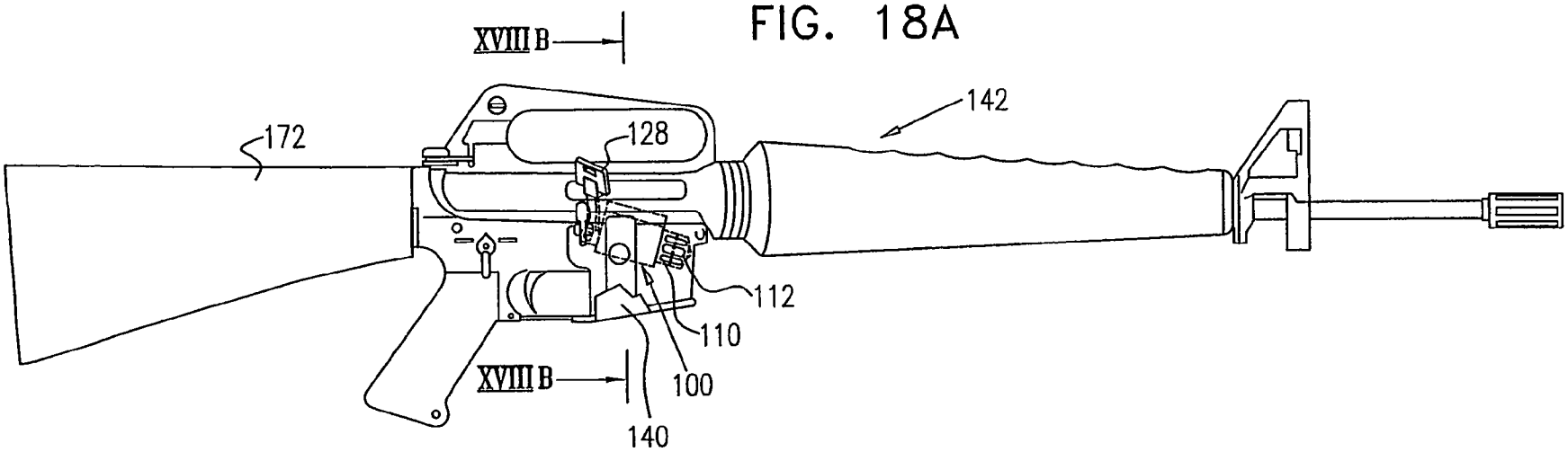
FIGS. 18A and 18B are respective side view and sectional illustrations showing removal of the firearm chamber lock of FIGS. 1A–1C from the firearm.
Figure 18B:
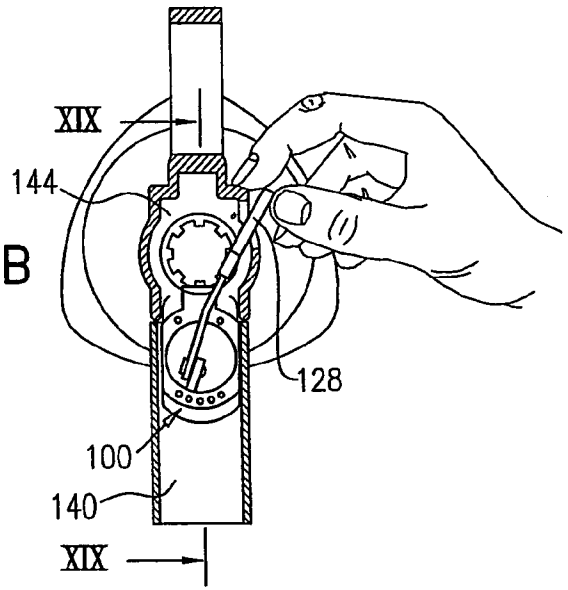
Figure 19:
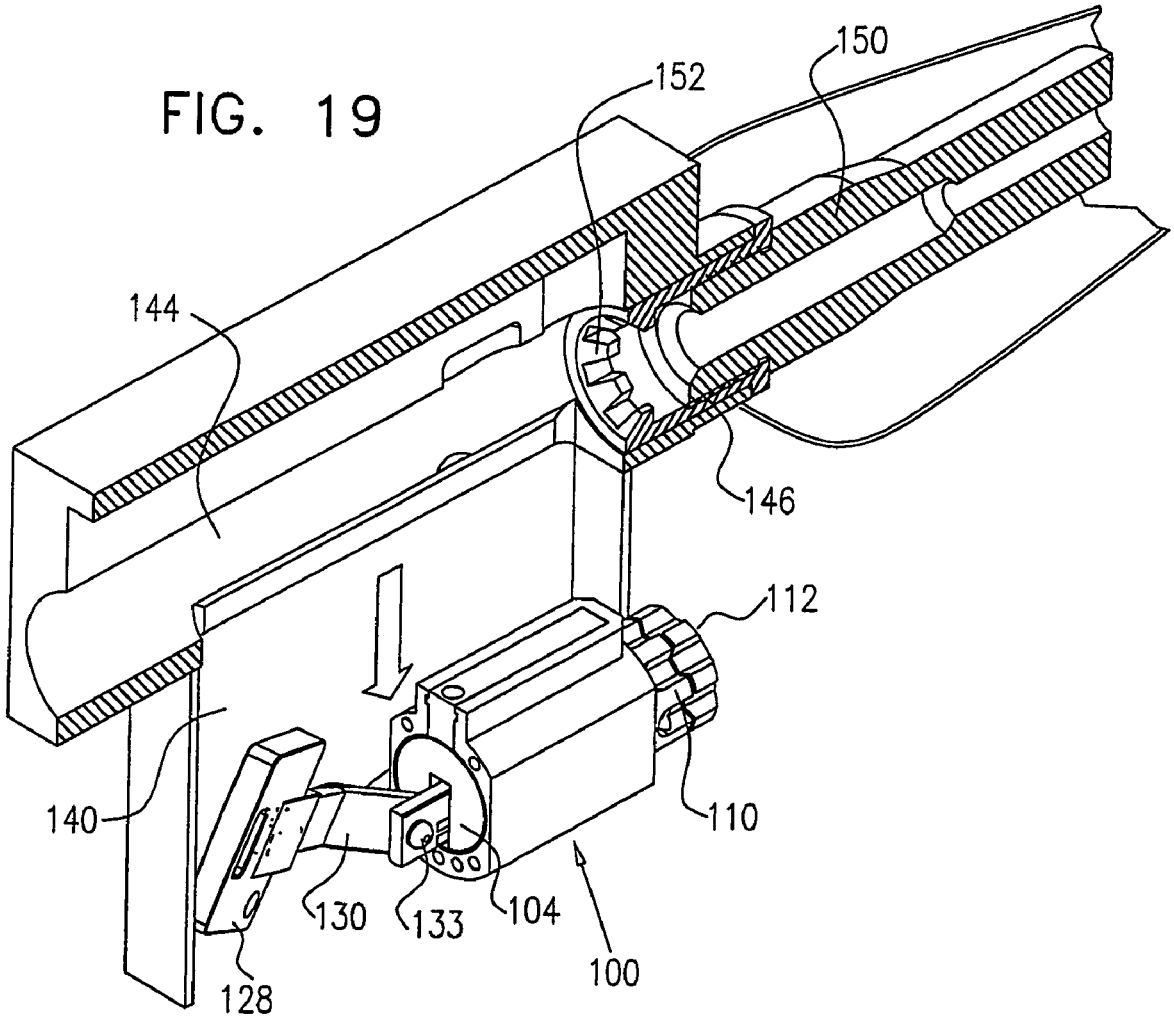
FIG. 19 is a partially pictorial, partially sectional illustration taken along lines XIX—XIX in FIG. 18B and showing details of the structure of the firearm disengaged from the firearm chamber lock.

Reference is now made to FIGS. 11A and 18B, which are respective side view and sectional illustrations showing removal of the firearm chamber lock of FIGS. 1A–1C from the firearm and to FIG. 19, taken along lines XIX—XIX in FIG. 18B, which shows details of the structure of the firearm lockingly disengaged by the firearm chamber lock.

As seen in FIGS. 18A, 18B and 19, the lock 100 together with the key assembly are preferably removed from the rifle 142 via the magazine holder 140.

Figure 20A:
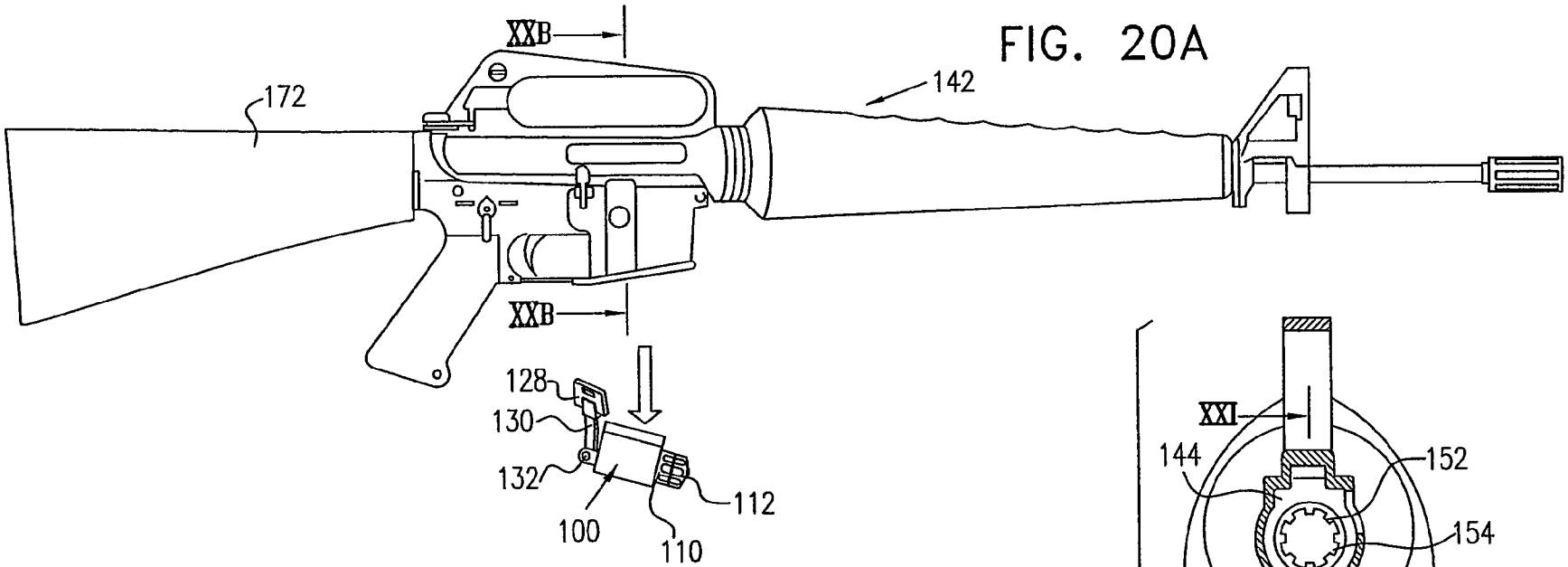
FIGS. 20A and 20B are respective side view and sectional illustrations showing a final stage in removal of the firearm chamber lock from operative locking engagement with a firearm.
Figure 20B:
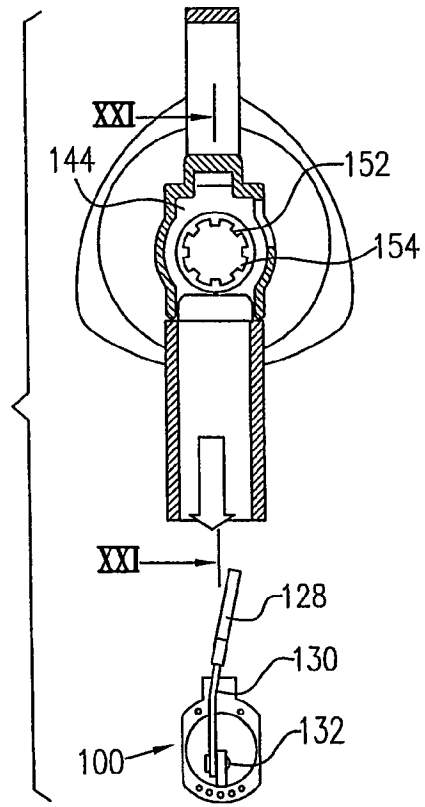
Figure 21:
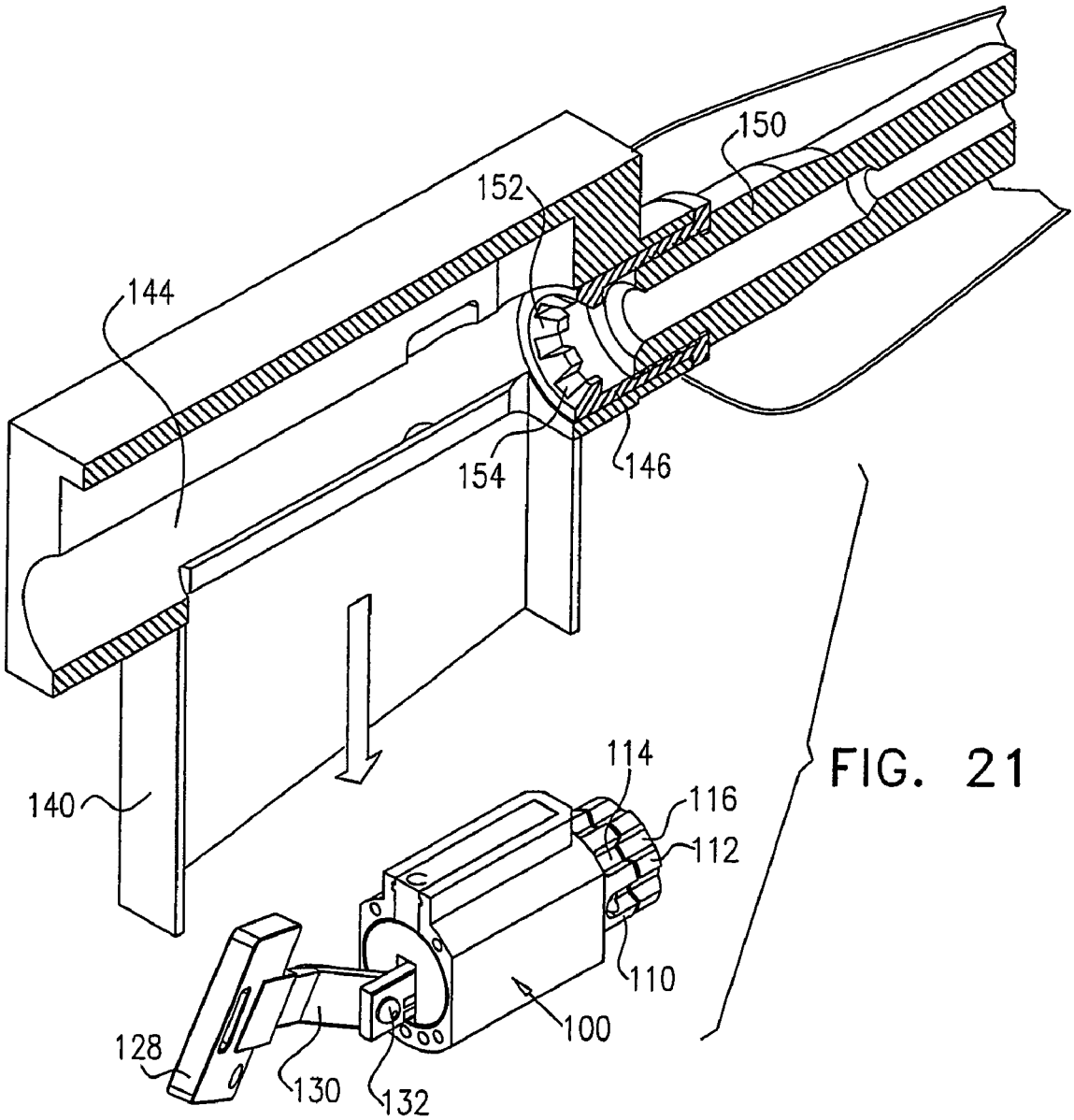
FIG. 21 is a partially pictorial, partially sectional illustration taken along lines XXI—XXI in FIG. 20B and showing details of the structure of the firearm and the lock which were earlier lockingly engaged.

Reference is now made to FIGS. 20A and 20B, which are respective side view and sectional illustrations showing a final stage in removal of the firearm chamber lock from operative locking engagement with a firearm and to FIG. 21, taken along lines XXI—XXI in FIG. 20B, which shows details of the structure of the firearm and the lock which were earlier lockingly engaged.

FIGS. 20A, 20B and 21 show the firearm lock 100 removed from the rifle 142.

Reference is now made to FIGS. 22A–30, which illustrate that alternative key arrangements may be employed with a firearm chamber lock 100 of the type shown in FIGS. 1A–1C. Although only one alternative embodiment is shown and described hereinbelow for the sake of conciseness, it is appreciated that many other alternative arrangements of key assemblies and keys may be employed.

Figure 22A:
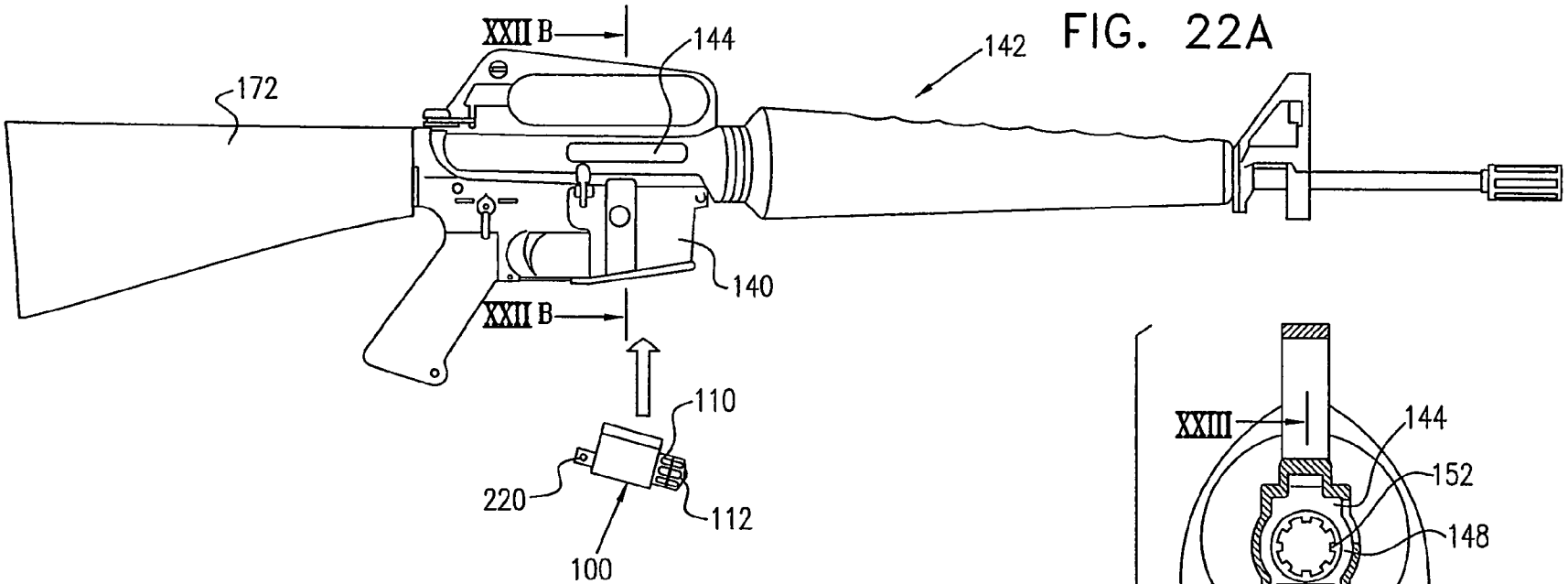
FIGS. 22A and 22B are respective side view and sectional illustrations showing an initial stage in insertion of a firearm chamber lock and key assembly of FIGS. 1A–1C into operative locking engagement with a firearm in accordance with an alternative embodiment of the present invention.
Figure 22B:
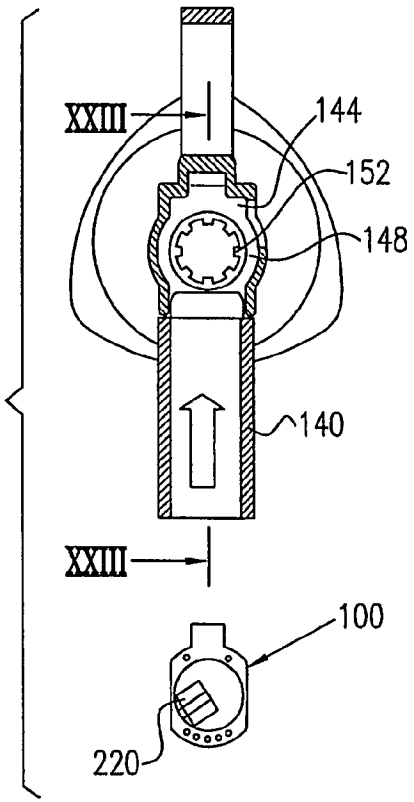
Figure 23:
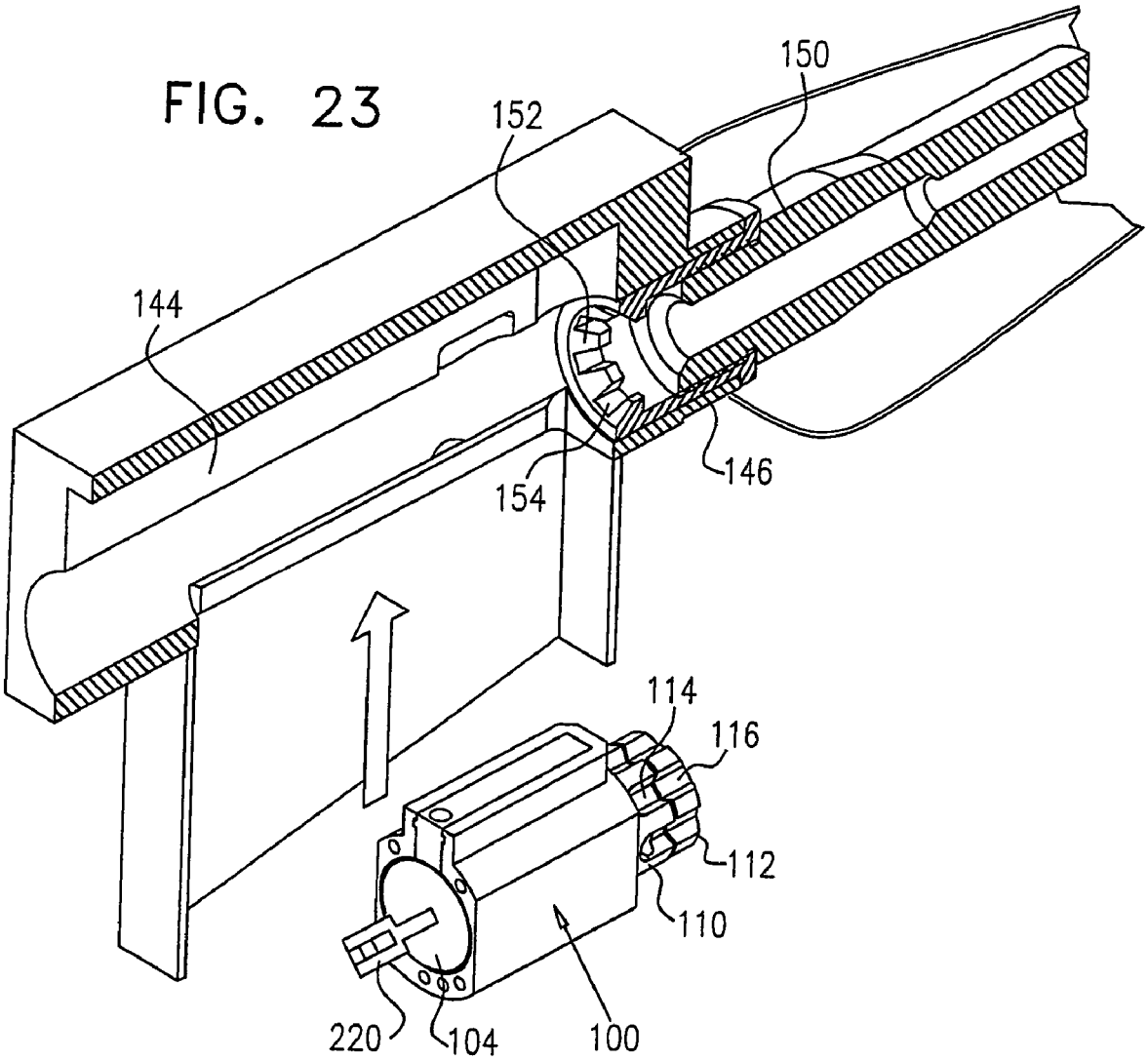
FIG. 23 is a partially pictorial, partially sectional illustration taken along lines XXIII—XXIII in FIG. 22B and showing details of the structure of the firearm which is to be lockingly engaged by the firearm chamber lock.

Reference is now made to FIGS. 22A and 22B, which are respective side view and sectional illustrations showing an initial stage in insertion of a firearm chamber lock and key assembly of FIGS. 1A–1C into operative locking engagement with a firearm in accordance with an alternative embodiment of the present invention and to FIG. 23, taken along lines XXIII—XXIII in FIG. 22B, which shows details of the structure of the firearm which is to be lockingly engaged by the firearm chamber lock.

The embodiment of FIGS. 22A, 22B and 23 may be identical to that of FIGS. 2A, 2B and 3, described hereinabove other than in that only a key shank 220 engages lock 100 during insertion thereof into the rifle 142. As a further alternative, the key shank 220 need not be located within lock 100 at the time of insertion.

Figure 24A:
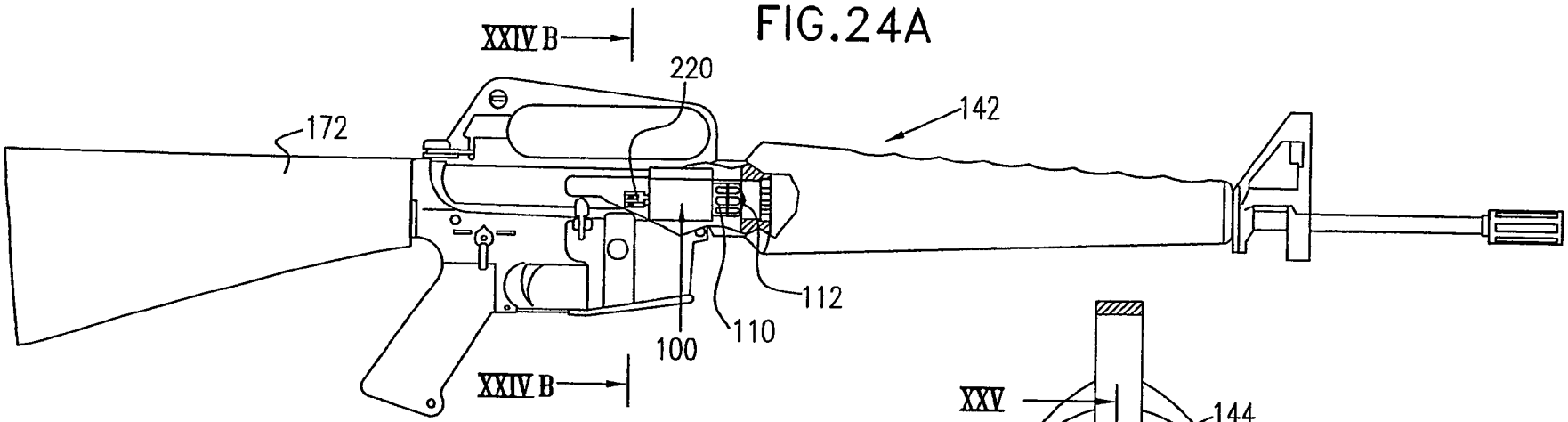
FIGS. 24A and 24B are respective side view and sectional illustrations showing a further stage in insertion of the firearm chamber lock and key assembly of FIGS. 22A–22C into operative locking engagement with a firearm.
Figure 24B:
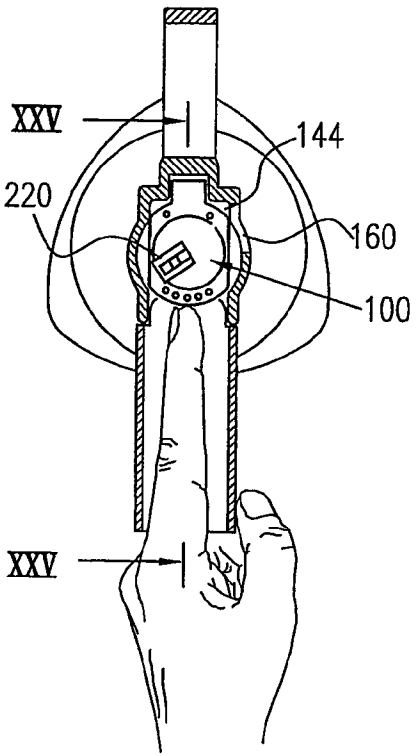
Figure 25:
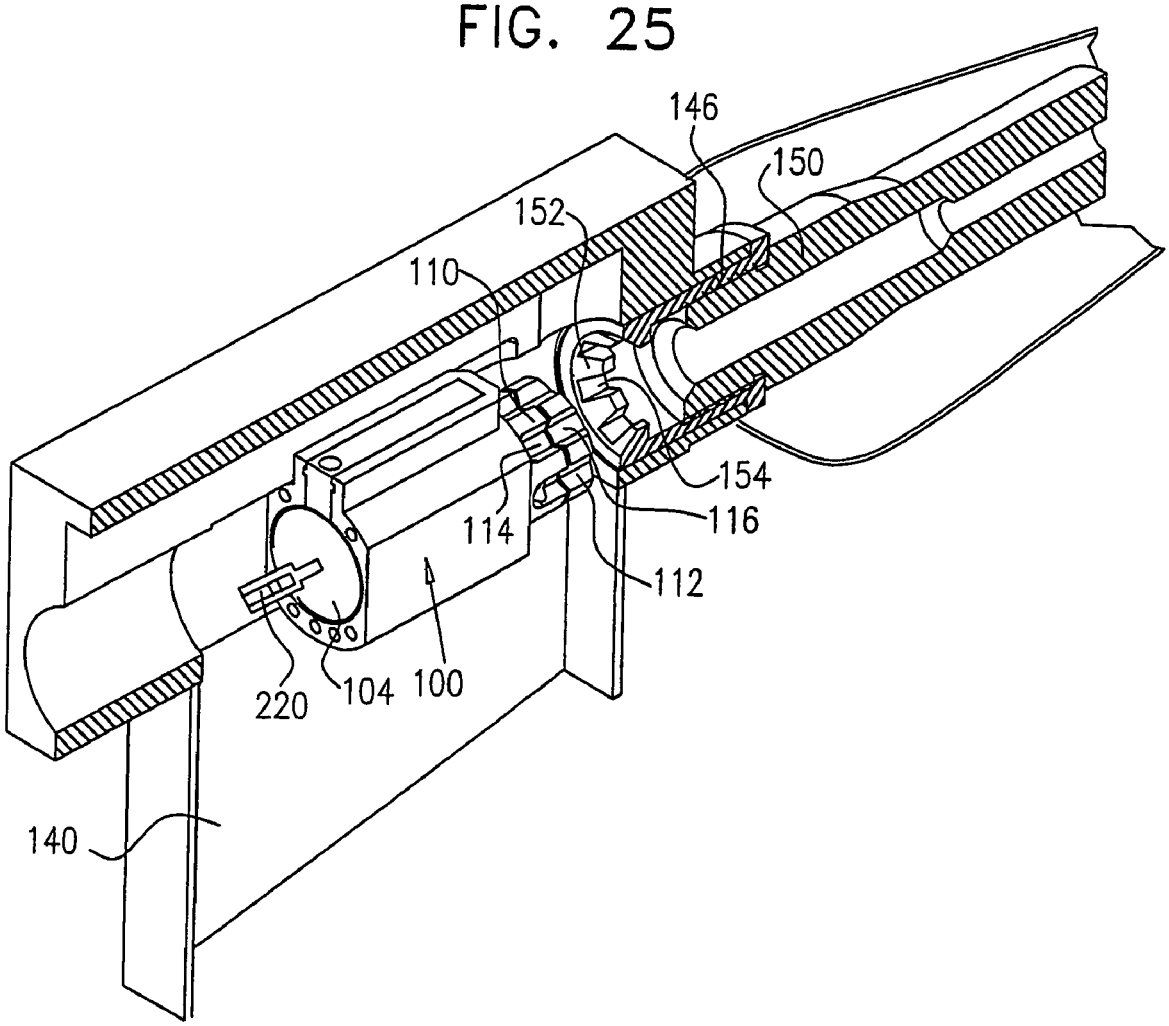
FIG. 25 is a partially pictorial, partially sectional illustration taken along lines XXV—XXV in FIG. 24B and showing details of the structure of the firearm which is to be lockingly engaged by the firearm chamber lock and the relative orientation thereof prior to locking engagement therebetween.

Reference is now made to FIGS. 24A and 24B, which are respective side view and sectional illustrations showing a further stage in insertion of the firearm chamber lock and key assembly of FIGS. 22A–22C into operative locking engagement with a firearm and to FIG. 25, taken along lines XXV—XXV in FIG. 24B, which shows details of the structure of the firearm which is to be lockingly engaged by the firearm chamber lock and the relative orientation thereof prior to locking engagement therebetween;

The embodiment of FIGS. 24A, 24B and 25 may be identical to that of FIGS. 4A, 4B and 5, described hereinabove other than in that only a key shank 220 engages lock 100 during insertion thereof into the rifle 142. As a further alternative, the key shank 220 need not be located within lock 100 at the time of insertion.

Figure 26A:
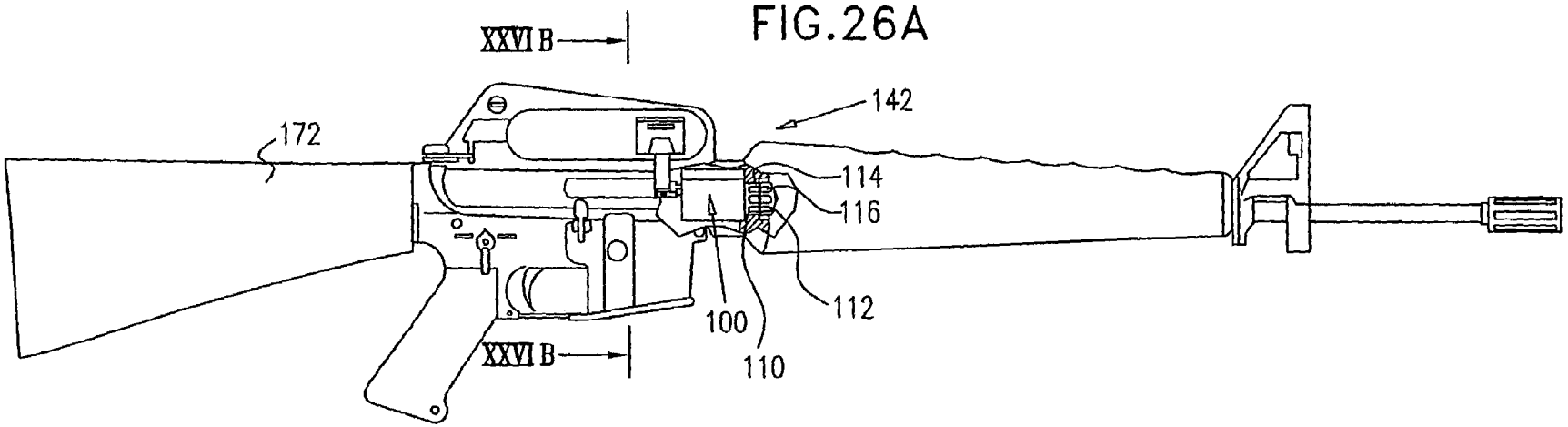
FIGS. 26A and 26B are respective side view and sectional illustrations showing a fill insertion, pre-locking stage in insertion of the firearm chamber lock and key assembly of FIGS. 22A–22C into operative locking engagement with a firearm.
Figure 26B:
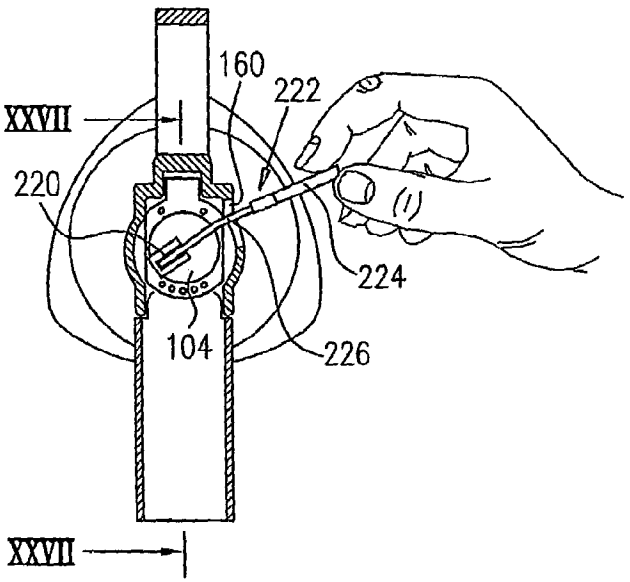
Figure 27:
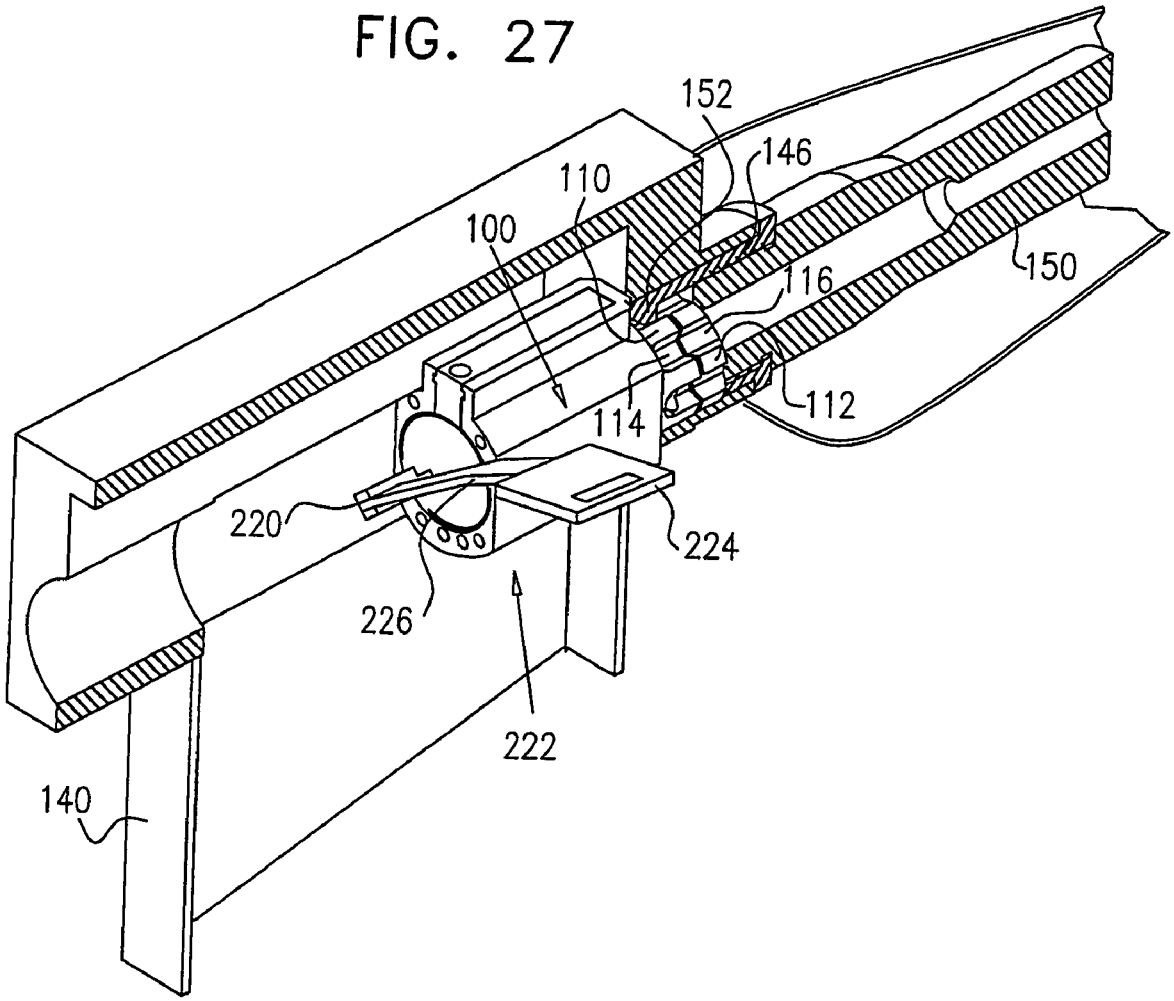
FIG. 27 is a partially pictorial, partially sectional illustration taken along lines XXVII—XXVII in FIG. 26B and showing details of the structure of the firearm which is to be lockingly engaged by the firearm chamber lock.

Reference is now made to FIGS. 26A and 26B, which are respective side view and sectional illustrations showing a full insertion, pre-locking stage in insertion of the firearm chamber lock and key assembly of FIGS. 22A–22C into operative locking engagement with a firearm and to FIG. 27, taken along lines XXVII—XXVII in FIG. 26B, which shows details of the structure of the firearm which is to be lockingly engaged by the firearm chamber lock.

The embodiment of FIGS. 26A, 26B and 27 may be identical to that of FIGS. 6A, 6B and 7, described hereinabove other than in that a separate key handle portion 222 including a key head 224 and a handle shaft 226 is manually brought into engagement with key shank 220 for rotation thereof in lock 100.

Figure 28A:
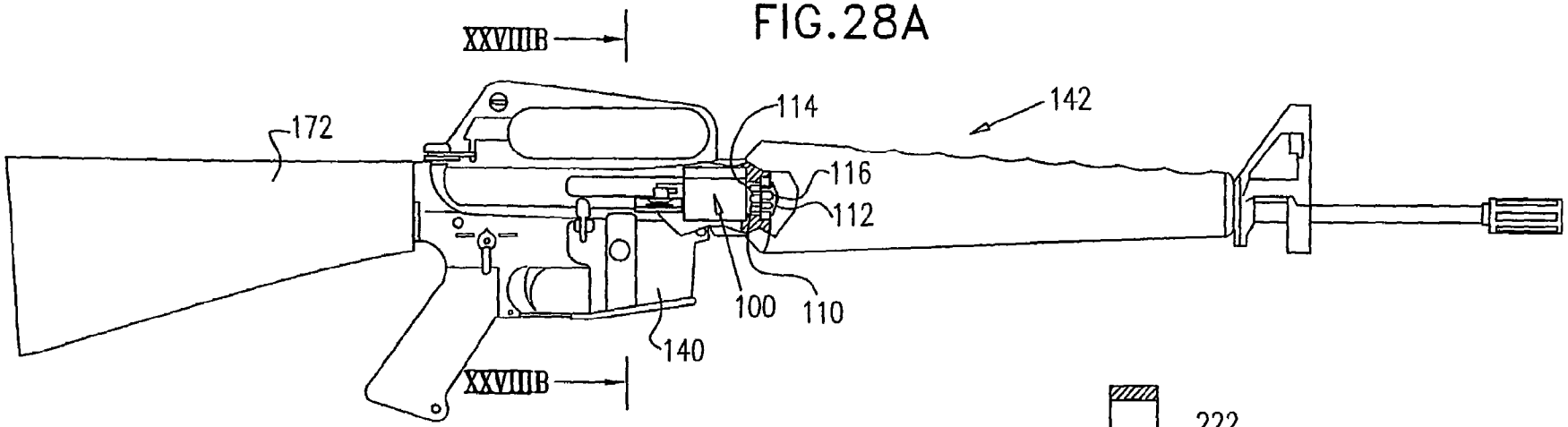
FIGS. 28A and 28B are respective side view and sectional illustrations showing locking engagement of the firearm chamber lock of FIGS. 22A–22C with a firearm.
Figure 28B:
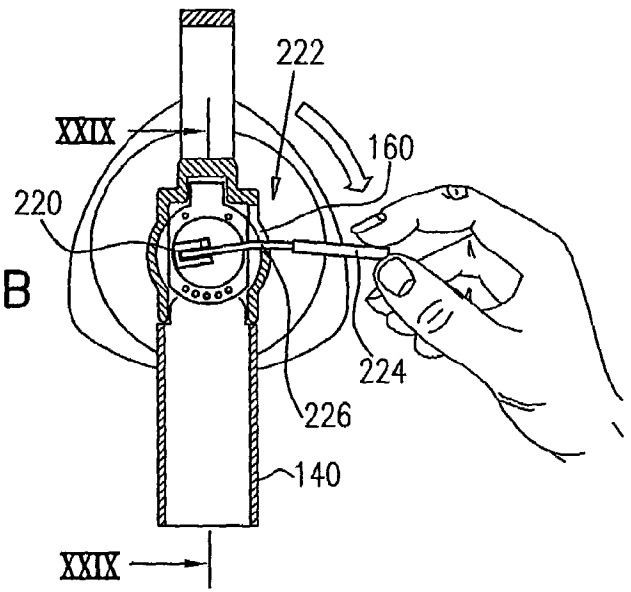
Figures 29, 30:
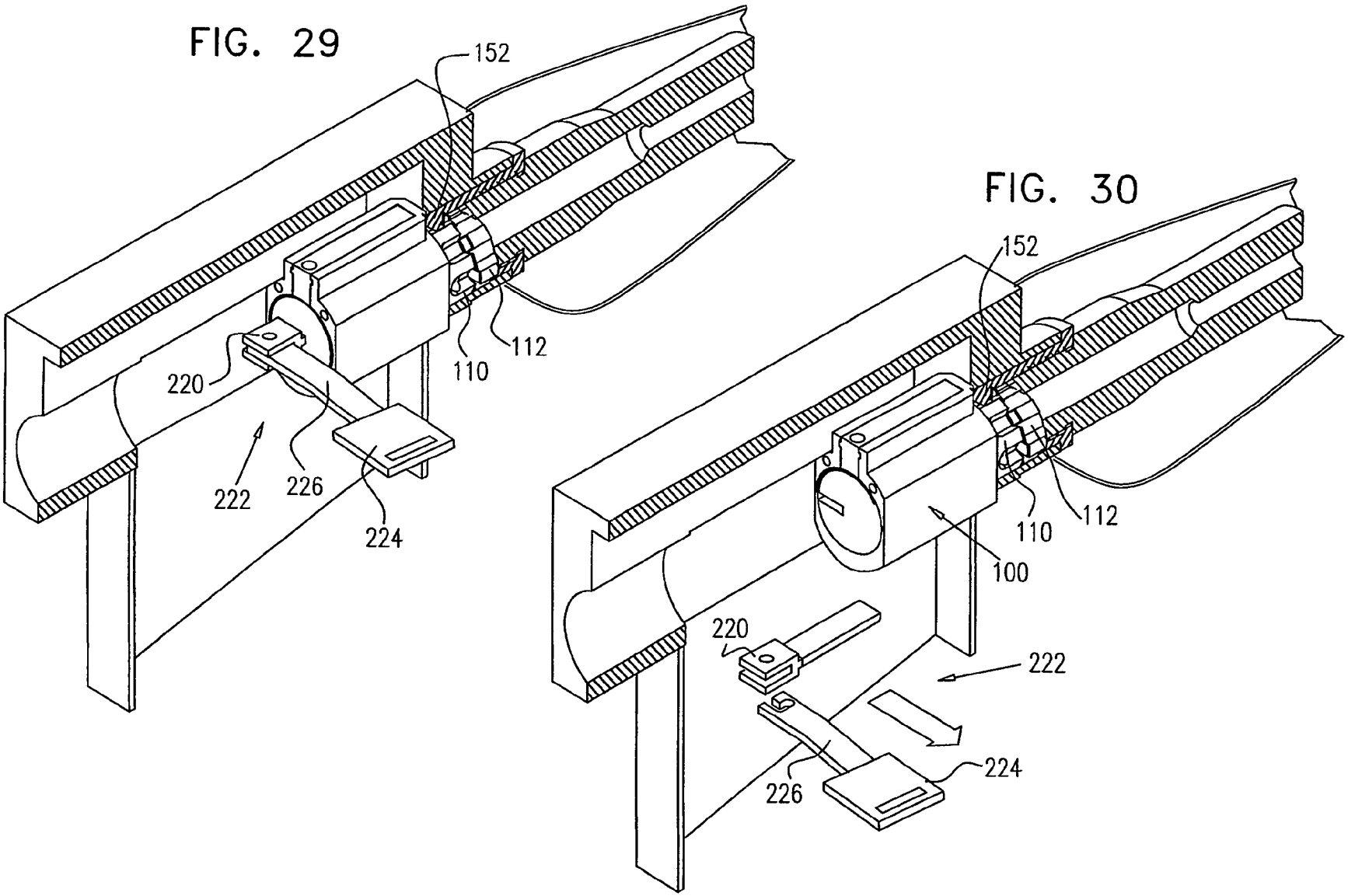
FIG. 29 is a partially pictorial, partially sectional illustration taken along lines XXIX—XXIX in FIG. 28B and showing details of the structure of the firearm lockingly engaged by the firearm chamber lock.
FIG. 30 is a partially pictorial, partially sectional illustration taken along lines XXIX—XXIX in FIG. 28B and showing details of the structure of the firearm lockingly engaged by the firearm chamber lock following removal of a key assembly therefrom.

Reference is now made to FIGS. 28A and 28B, which are respective side view and sectional illustrations showing locking engagement of the firearm chamber lock of FIGS. 22A–22C with a firearm and to FIGS. 29 and 30, taken along lines XXIX—XXIX in FIG. 28B, which show details of the structure of the firearm lockingly engaged by the firearm chamber lock.

The embodiment of FIGS. 28A, 28B, 29 and 30 may be identical to that of FIGS. 8A, 8B, 9 and 11, described hereinabove, other than in that a separate key handle portion 222 including a key head 224 and a handle shaft 226 is manually brought into engagement with key shank 220 for rotation thereof in lock 100.

It will be appreciated by persons skilled in the art that the present invention is not limited by what has been particularly shown and described hereinabove. Rather the scope of the present invention includes both combinations and sub-combinations of the various features described hereinabove as well as variations and modifications which would occur to persons skilled in the art upon reading the specification and which are not in the prior art.

The invention claimed is:

1. A firearm lock comprising:

a lock which is lockingly engageable with an interior portion of a firing chamber of a firearm;

and wherein said lock further comprises:

a cylinder lock body including a plug rotatable therewithin;

an inner multiply grooved generally circular cylindrical portion fixed to or integrally formed with a first end of said lock body; and an outer circular cylindrical portion, having a correspondingly multiply grooved generally circular cylindrical portion, fixed to or integrally formed with said plug for rotation therewith between a locked orientation, wherein grooves on said inner cylindrical portion are arranged out of phase with corresponding grooves on said outer cylindrical portion, and an unlocked orientation, wherein said grooves on said inner and outer cylindrical portions are mutually aligned.

2. A firearm lock according to claim 1 and wherein said lock is lockingly engageable with said interior portion of said firing chamber at a location between said firing chamber and a firearm barrel, whereby the presence of said lock effectively blocks a bullet travel path in the barrel and prevents firing of the firearm.

3. A firearm lock according to claim 1 and wherein said firearm lock is insertable into locking engagement with said firearm via a magazine holder of the firearm.

4. A firearm lock according to claim 1 and wherein said firearm lock is key-operated.

5. A firearm lock according to claim 1 and wherein locking and unlocking of said firearm lock is carried out via an aperture communicating with said firing chamber of said firearm.

6. A firearm lock according to claim 1 and wherein said outer cylindrical portion is formed with a hardened or otherwise reinforced central portion in order to provide security against drilling therethrough.

7. A firearm locking method comprising:

mounting a lock with respect to a firing chamber of a firearm, and lockingly engaging the lock with an interior portion of the firing chamber, wherein said lock comprises:

a cylinder lock body including a plug rotatable therewithin;

an inner multiply grooved generally circular cylindrical portion fixed to or integrally formed with a first end of said lock body; and an outer circular cylindrical portion, having a correspondingly multiply grooved generally circular cylindrical portion, fixed to or integrally formed with said plug for rotation therewith between a locked orientation, wherein grooves on said inner cylindrical portion are arranged out of phase with corresponding grooves on said outer cylindrical portion, and an unlocked orientation, wherein said grooves on said inner and outer cylindrical portions are mutually aligned.

8. A firearm locking method according to claim 7 and wherein said lock is lockingly engageable with said interior portion of said firing chamber at a location between said firing chamber and said barrel, whereby the presence of said lock effectively blocks a bullet travel path and prevents firing of the firearm.

9. A firearm locking method according to claim 7 and wherein said firearm lock is insertable into locking engagement with said firearm via a magazine holder of the firearm.

10. A firearm locking method according to claim 7 and wherein said firearm lock is key-operated.

11. A firearm locking method according to claim 7 and wherein locking and unlocking of said firearm lock is carried out via an aperture communicating with said firing chamber of said firearm.

12. A firearm locking method according to claim 7 and wherein said outer cylindrical portion is formed with a hardened or otherwise reinforced central portion in order to provide security against drilling therethrough.

* * * * *